US011369012B2

(12) United States Patent
Langford et al.

(10) Patent No.: US 11,369,012 B2
(45) Date of Patent: Jun. 21, 2022

(54) COMBINATION LIFTING MECHANISM FOR MICROWAVE OVEN AND COOKING RANGE VENTILATING HOOD

(71) Applicants: William Langford, Winfield, IL (US); Chase Langford, Winfield, IL (US)

(72) Inventors: William Langford, Winfield, IL (US); Chase Langford, Winfield, IL (US)

( * ) Notice: Subject to any disclaimer, the term of this patent is extended or adjusted under 35 U.S.C. 154(b) by 0 days.

(21) Appl. No.: 16/919,281

(22) Filed: Jul. 2, 2020

(65) Prior Publication Data

US 2021/0243854 A1 Aug. 5, 2021

Related U.S. Application Data

(60) Provisional application No. 62/869,904, filed on Jul. 2, 2019.

(51) Int. Cl.
*H05B 6/64* (2006.01)
*F24C 15/20* (2006.01)

(52) U.S. Cl.
CPC ..... *H05B 6/6423* (2013.01); *F24C 15/20* (2013.01); *H05B 6/6429* (2013.01)

(58) Field of Classification Search
CPC .... H05B 6/6402; H05B 6/642; H05B 6/6423; H05B 6/6426; H05B 6/6429; H05B 6/647; H05B 6/6473; F24C 15/027; F24C 15/10; F24C 15/16; F24C 15/162; F24C 15/20; F24C 15/2085; F24C 15/30
USPC ..... 219/752, 753, 756, 757, 762, 763; 126/273 R, 273 A, 332, 334, 335, 337 A, 126/337 R
See application file for complete search history.

(56) References Cited

U.S. PATENT DOCUMENTS

| | | | | |
|---|---|---|---|---|
| 2,658,985 A | | 11/1953 | Maxwell | |
| 2,889,442 A | * | 6/1959 | Schultz | F24C 15/027 219/398 |
| 2,944,540 A | * | 7/1960 | Littell, Jr. | F24C 15/16 126/273 A |
| 3,027,216 A | | 3/1962 | Alstyne et al. | |
| 3,464,749 A | | 9/1969 | Bishop | |
| 4,766,881 A | | 8/1988 | Pax | |
| 6,073,624 A | * | 6/2000 | Laurent | A47B 46/005 126/273 A |

(Continued)

FOREIGN PATENT DOCUMENTS

| | | |
|---|---|---|
| JP | H05317131 | 12/1993 |
| KR | 20080076172 | 8/2008 |

(Continued)

*Primary Examiner* — Hung D Nguyen
(74) *Attorney, Agent, or Firm* — Erickson Law Group, PC

(57) ABSTRACT

A combination lifting mechanism for a microwave oven, or other appliance, and a cooking range ventilating hood. The lifting mechanism lifts the microwave within the open bottom portion of the hood and lowers the microwave oven for user access into the microwave oven. The lifting mechanism includes a support plate for the microwave oven and a lifting belt attached to the support plate. A motor wraps or unwraps a lifting belt onto a spool to either raise or lower the support plate. An isolation chamber is located in the open lower portion of the hood and is sized and configured to receive the microwave over therein to protect the microwave oven from cooking gas and grease when the range below is used during cooking.

18 Claims, 38 Drawing Sheets

(56) References Cited

U.S. PATENT DOCUMENTS

| | | | | |
|---|---|---|---|---|
| 6,843,245 | B2 * | 1/2005 | Roch | F24C 15/162 126/19 M |
| 6,992,273 | B2 | 1/2006 | Yim et al. | |
| 8,113,606 | B2 | 2/2012 | Greenberg | |
| 8,622,488 | B1 | 1/2014 | Kilby et al. | |
| 8,991,948 | B2 | 3/2015 | Marsters et al. | |
| 9,513,016 | B2 * | 12/2016 | Martin | F24C 15/027 |
| 2004/0261784 | A1 * | 12/2004 | Kuttalek | F24C 15/027 126/273 A |
| 2009/0229475 | A1 * | 9/2009 | Bally | F24C 15/027 99/337 |

FOREIGN PATENT DOCUMENTS

| | | |
|---|---|---|
| KR | 100866501 | 11/2008 |
| KR | 20100023520 | 4/2010 |

* cited by examiner

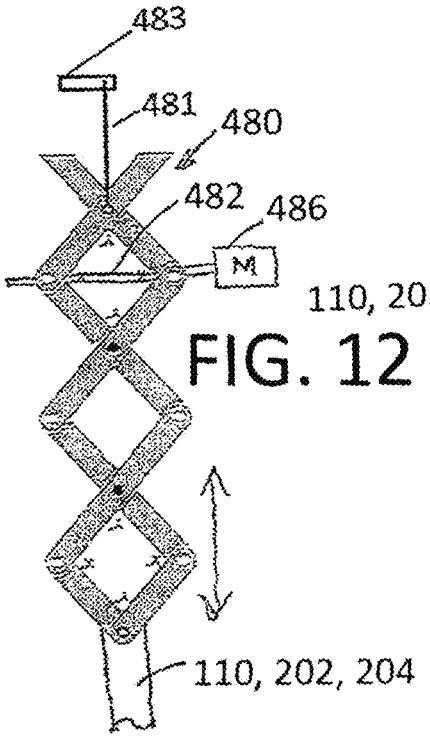
FIG. 12
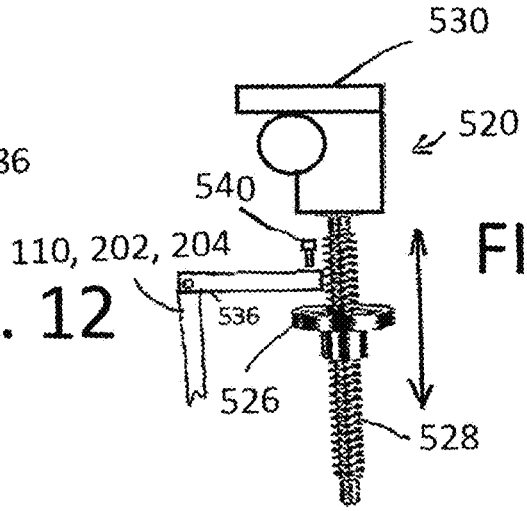
FIG. 13
FIG. 14
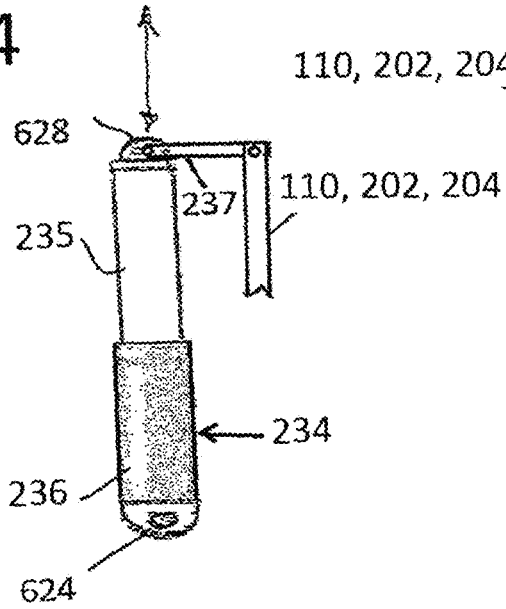
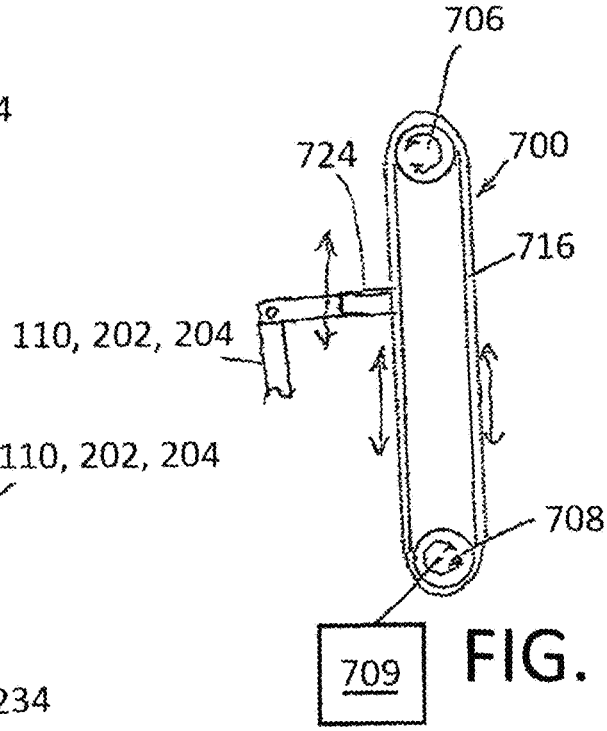
FIG. 15

COMBINATION LIFTING MECHANISM FOR MICROWAVE OVEN AND COOKING RANGE VENTILATING HOOD

This application claims the benefit of U.S. Provisional Application No. 62/869,904, filed Jul. 2, 2019.

BACKGROUND

Combined microwave ovens and ventilation hoods adapted for mounting above a kitchen cooking range are known.

Providing a microwave above a cooking range is challenging. The microwave must be elevated above the cooking range a certain required height while the space through and above the microwave is limited for providing a ventilation system for the cooking range.

Some patents that describe the combination of a microwave oven and a cooking range are: U.S. Pat. Nos. 4,143,646; 4,327,274; 4,418,261; 5,042,458; 6,218,654; 6,768,090; and 7,470,877.

While some of these patents describe ventilation paths with a microwave oven, the resultant configurations utilize parts of the microwave housing to form part of the ventilating path and hood function. The combined units are utilitarian in appearance.

In contrast, FIG. 1 illustrates a kitchen installation with an aesthetically pleasing hood 10 mounted flush onto a room wall 15 above an oven range 16. This type of hood is typically composed of stainless steel and is present in modern and elegant kitchens. The hood includes lighting on a bottom facing surface, an exhaust fan within the hood and filter panels also on a bottom surface of the hood. The hood includes a flared lower portion 20 and a straight-rectangular upper duct or chimney 22. A top opening 26 as shown can be open to an opening in the ceiling or can have a back opening to exhaust though the vertical wall of the kitchen. Alternatively, the top opening can be through a sidewall of the duct into the room without being exhausted outside.

The present inventors have recognized a need for an improved combination microwave oven-ventilating hood system, which eliminates or at least alleviates the disadvantages of prior art combination systems.

The present inventors have recognized the desirability of providing a combination microwave oven and cooking range ventilation hood that reduces the size of the microwave oven, eliminates the need for the microwave oven to provide vent ducting, and presented an uncluttered appearance to the combination.

The present inventors have recognized the desirability of providing a combination microwave oven and cooking range ventilation hood that an elegant appearance to the combination.

SUMMARY

A combination lifting mechanism for a microwave oven, or other appliance, and a cooking range ventilating hood are sized and arranged to lift a microwave oven, or other appliance, up into the hood to conceal the microwave oven. Furthermore, the microwave oven can be lowered from being at least partly concealed within the hood to a position wherein controls are available to the user and food can be placed within the microwave oven.

After lowering, the microwave oven can be activated to cook and then either left at the lowered position for operation or raised to complete cooking at an elevated level at least partly concealed by the hood. Furthermore, when not in use, the microwave oven can be raised to be at least partly concealed in the hood. Advantageously, the microwave oven can be raised to be completely concealed within the hood.

The mechanism for lowering and raising the microwave oven can be a coiled strap on a rotatable spool or can be chosen from a number of known lifting mechanisms including a scissor jack lifting mechanism, a linear actuator mechanism, a pneumatic or hydraulic mechanism, a screw linear actuator, a rack and pinion arrangement or other known mechanism. Furthermore, the microwave can be moved essentially vertically or can also be swung in an arc to be lowered and revealed from within the hood.

In one embodiment, the compartment of the microwave oven is fixedly mounted inside the flared portion and only the floor of the microwave is lowered to load food articles and then raised and seals the compartment within the flared portion of the hood. In this embodiment the microwave is more integrated into the hood. Microwave controls can be operated on the outside surface of the hood.

In further embodiments the hood includes a lower hood portion and a connected vertical duct or chimney. The chimney is sized with sufficient transverse dimensions that a microwave oven, or other small appliances such as a coffee maker, toaster oven or conventional toaster or multiple small appliances can be lifted when not in use into the chimney. Sufficient space around the chimney allows for the venting of cooking gases or vapors.

In further embodiments, a simulated kitchen cabinet has an open bottom. A lifting mechanism is configured to lift one or more small appliances up into the cabinet when not in use and lower the appliances when use is desired. This allows the user to have clear counter space below the cabinet with the appliances stored above out of view, while being able to lower the small appliances down from the cabinet for use when needed.

Numerous other advantages and features of the present invention will be become readily apparent from the following detailed description of the invention and the embodiments thereof, and from the accompanying drawings.

BRIEF DESCRIPTION OF THE DRAWINGS

FIG. 12 is a schematic elevation view of a scissor jack for raising and lowering a microwave oven with respect to a hood;

FIG. 13 is a schematic elevation view of a screw drive for raising and lowering a microwave oven with respect to a hood;

FIG. 14 is schematic elevation view of a pneumatic or hydraulic cylinder for raising and lowering a microwave oven with respect to a hood;

FIG. 15 is a schematic diagram of a belt type mechanism for raising and lowering a microwave oven with respect to a hood;

DETAILED DESCRIPTION

Figure 1:
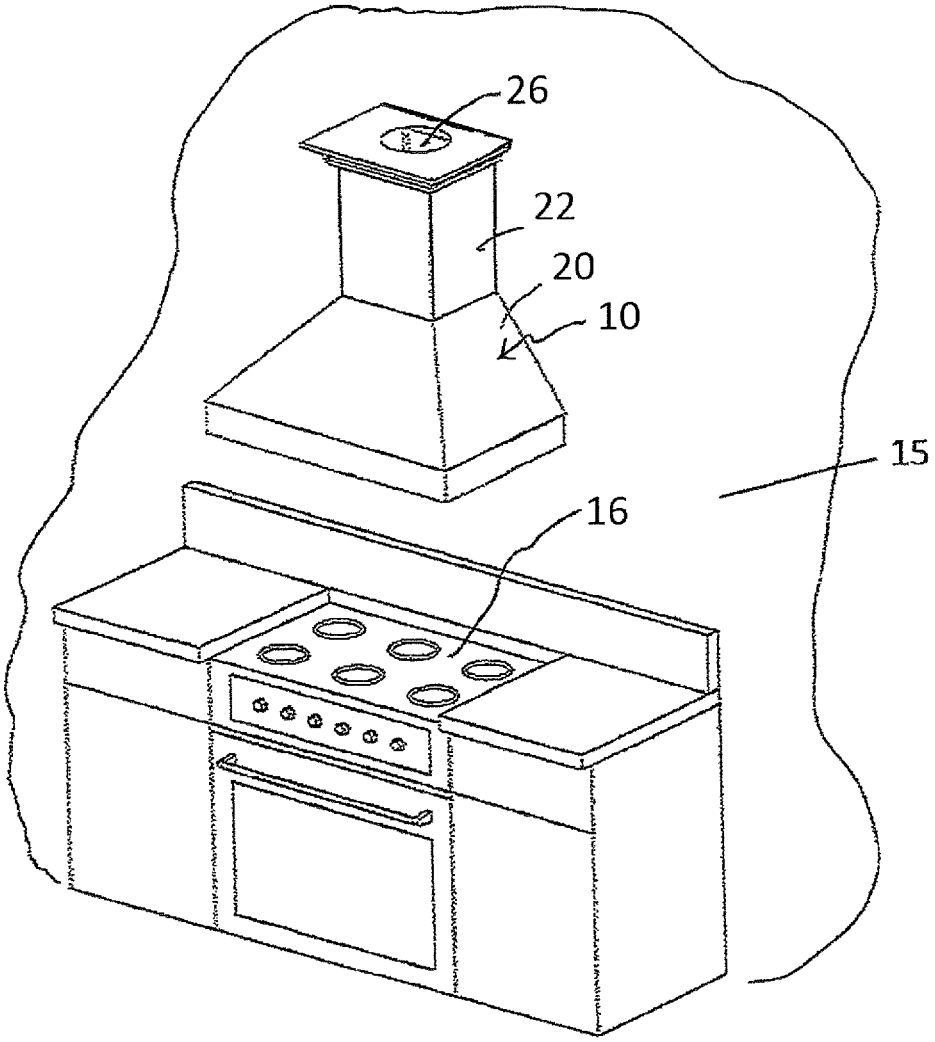
FIG. 1 PRIOR ART
FIG. 1 is a schematic perspective view of a prior art ventilating hood mounted on a wall above a kitchen range.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

This application incorporates by reference U.S. Provisional Application No. 62/869,904, filed Jul. 2, 2019, in its entirety.

Figure 2:
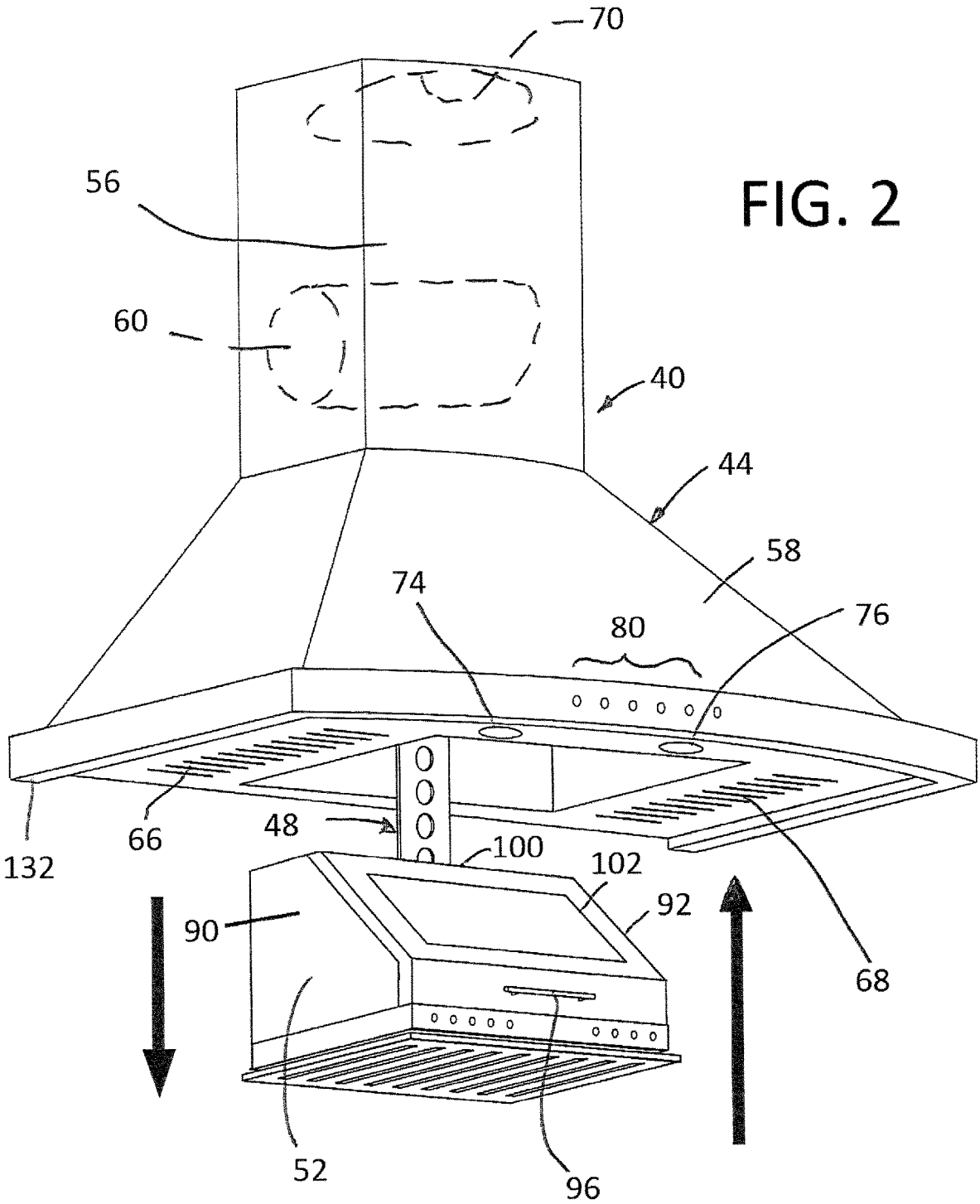
FIG. 2 is a schematic perspective view of a first embodiment combination lifting-mechanism and range-hood of the invention, with the microwave oven shown in a lowered position.

FIG. 2 illustrates a first embodiment combination range-hood and lifting-mechanism 40 of the present invention. The combination 40 includes a hood 44 and a lifting assembly 48. The lifting assembly supports a microwave oven 52, or other appliance.

The hood 44 includes a substantially straight vertical duct or chimney 56 and a horn or flared portion 58, flow connected to the duct 56.

An exhaust fan 60 (shown schematically) is located within the duct 44 to draw air and exhaust gases up through slotted areas or vents 66, 68 (FIG. 6) or alternatively, removable screens 66*a*, 68*a* (FIG. 6A), through the flared portion 58 and up through the duct 56. The duct 56 includes an opening 70 wherein the air and exhaust gases and vapors can flow through additional ducting (not shown) to an outside of the house or building. Alternatively, the opening can be straight into the kitchen.

All of the embodiments described in this specification can be outfitted with slotted areas 66, 68 or removable screens 66*a*, 68*a* interchangeably.

Two lights 74, 76 illuminate a top surface of the range (FIG. 1) below. A set of control buttons 80 control the exhaust fan speed and turn on/off the lights 74, 76.

The microwave oven 52 is a conventionally operated microwave oven except its profile includes a tapered upper portion 90 that is opened and closed by a two-plane door 92 that is opened by lifting a handle 96 and pivoting the door 92 about a hinge located on its top edge 100. Thus, the door 92 is a lift open-door about a horizontal axis rather than a conventional microwave oven door that pivots open about a vertical axis along one side edge of the door. The door 92 includes a glass observation window 102 to observe food cooking inside the microwave.

Figure 3:
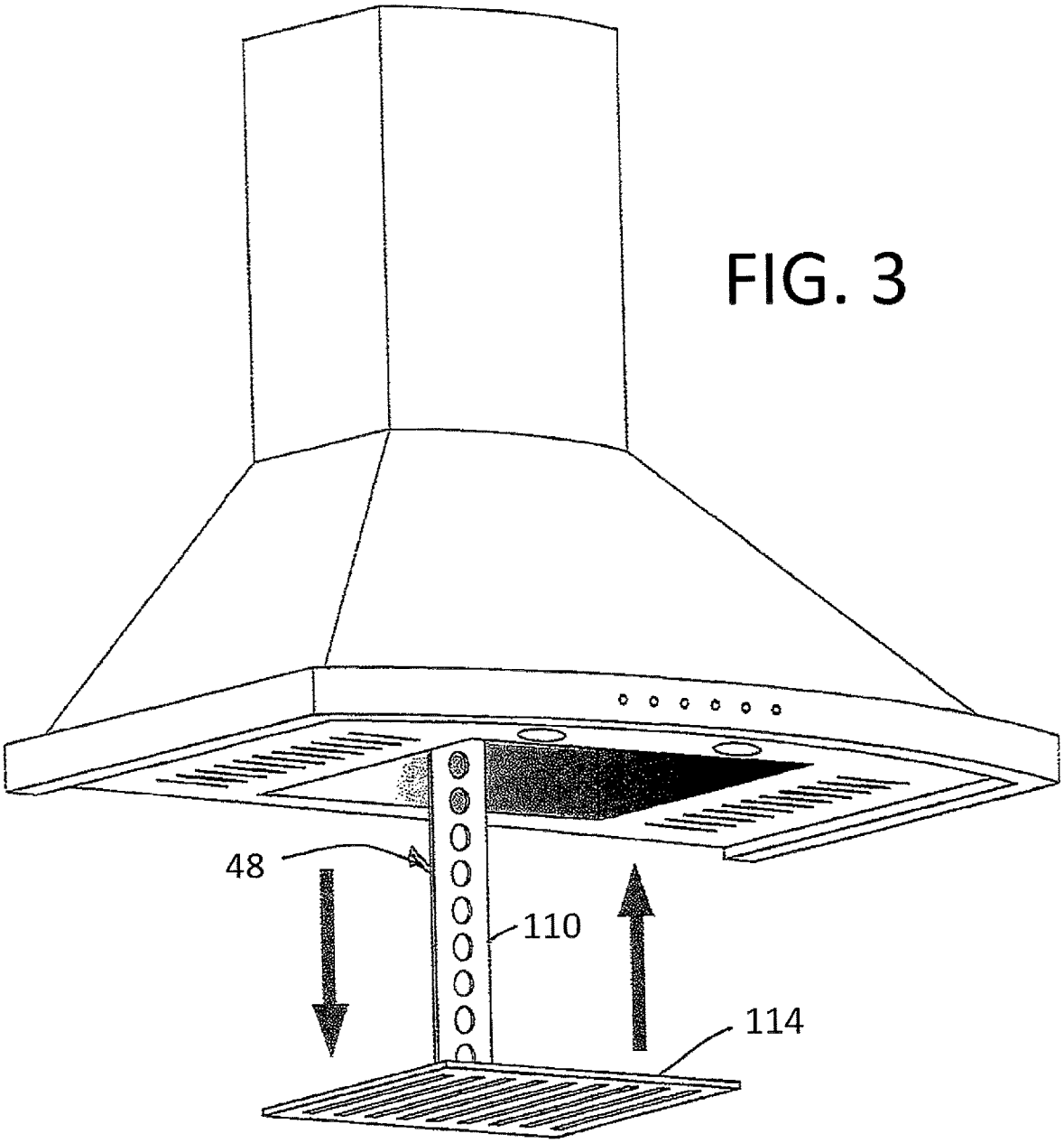
FIG. 3 is a schematic perspective view of the first embodiment of FIG. 2 with the microwave oven removed to see underlying parts.

As shown more clearly in FIG. 3, the lifting assembly 48 includes a vertical rod or bar 110 that is connected to a horizontal support plate 114. The microwave oven 52 can be simply supported by resting on the support plate 114, or can be fastened to the plate 114.

Figure 4:
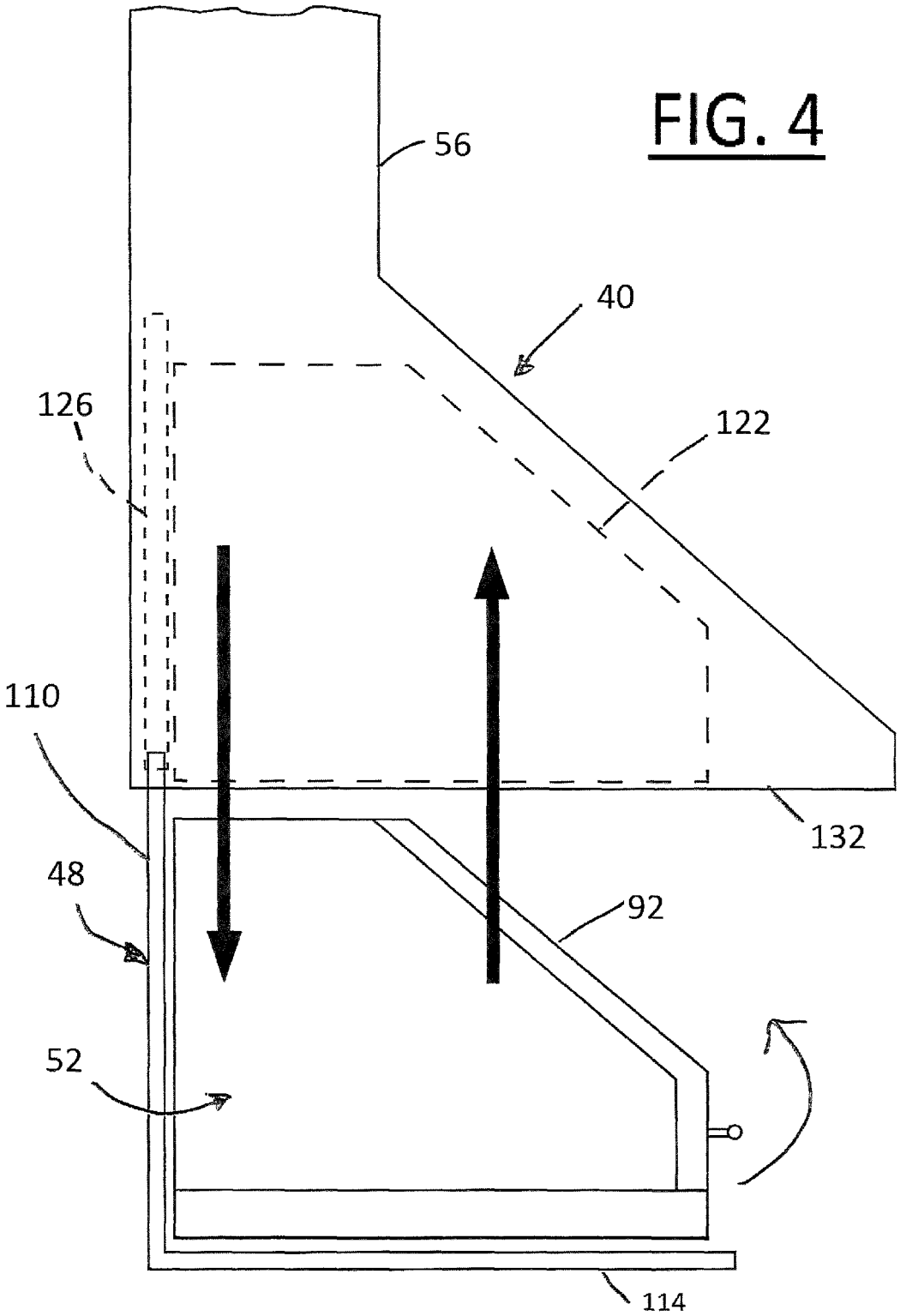
FIG. 4 is a schematic side view of the first embodiment of FIG. 2, with the microwave oven shown in a lowered position.

As shown in FIG. 4, the lifting assembly 48 can be raised up into the flared portion 58 as indicated by dashed lines 122. The support bar 110 is raised within an enclosed rectangular tube 126 by a powered lifting mechanism 134 (described below). For stability of operation, a slide rail type bearing can be used inside of the tube 126 to ensure smooth up and down movement of the support bar 110 and the equipment it lifts.

The dashed lines 122 can also represent a sheet metal compartment in the hood to protect the microwave oven, when lifted into the hood, from greasy deposits from the cooking exhaust gas and vapors.

Figure 4A:
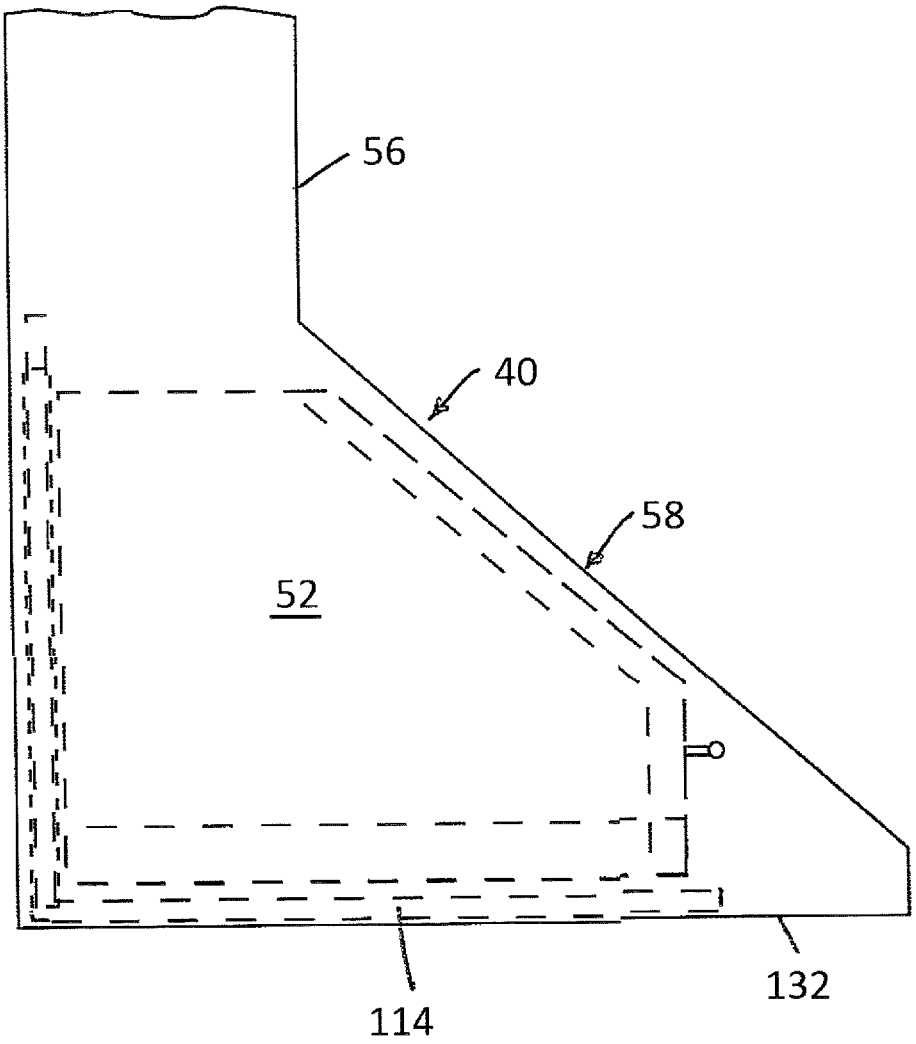
FIG. 4A is a schematic side view of the first embodiment of FIG. 2, with the microwave oven shown in a raised position, within the hood.

FIG. 4A shows the microwave oven 52 in place up inside the flared portion 58 of the hood 44, the bottom plate 114 being substantially flush with a bottom edge 132 of the flared portion 58 of the hood 44. Alternatively, the plate 114 can be recessed a small amount above the edge 132 or extend a small amount below the edge 132.

Figure 5:
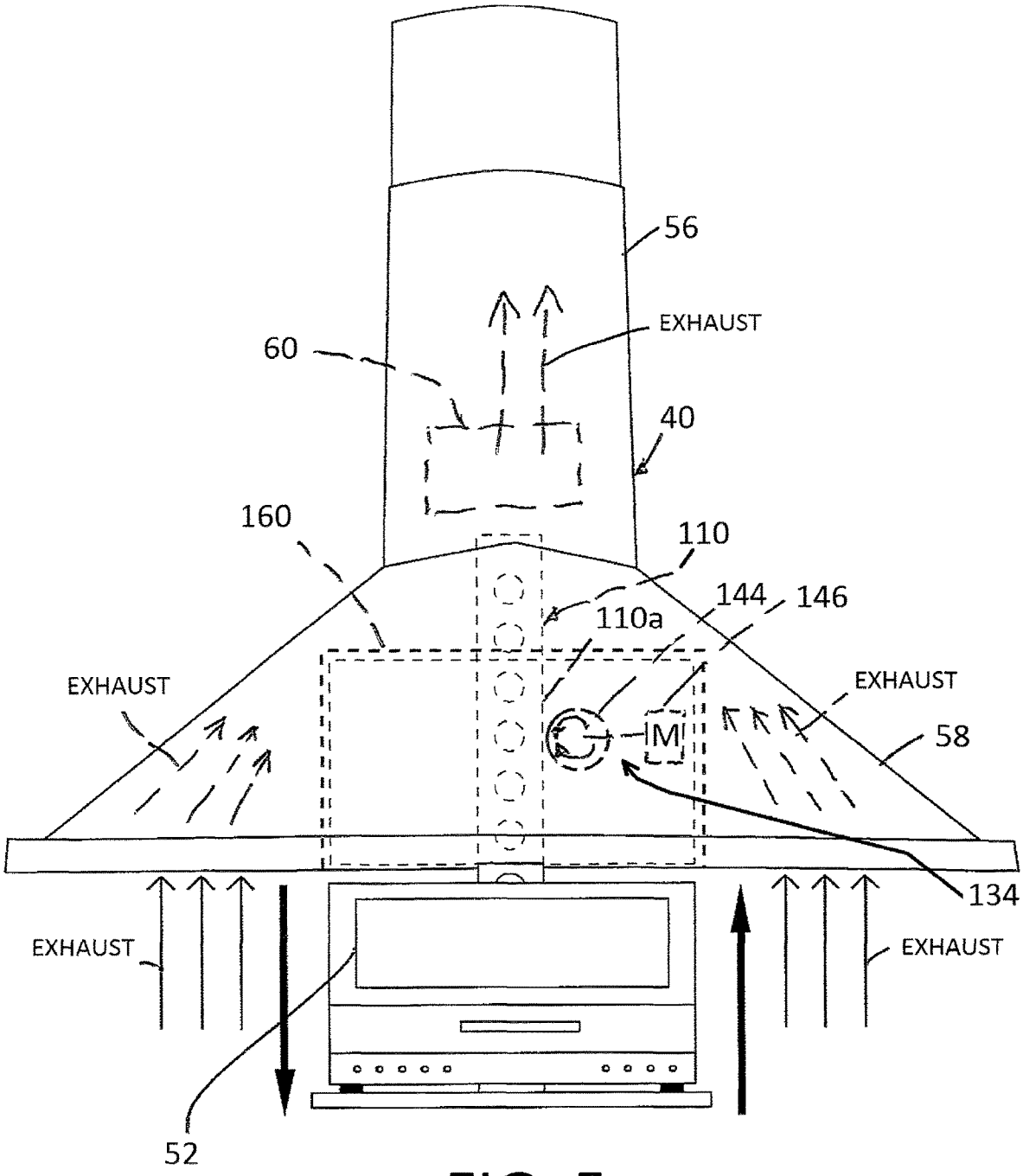
FIG. 5 is a schematic front view of the first embodiment of FIG. 2.

FIG. 5 illustrates one manner of raising the support bar 110. An edge 110*a* of the support bar 110 can be a toothed edge and a toothed pinion gear 144 can be pivotally mounted to the hood 44 with its teeth meshed with the toothed edge 110*a*. The toothed pinion gear 144 is driven in rotation by a motor 146 which, depending on the direction of rotation, will drive the support bar 110 and the entire support assembly 48 upward or downward. In effect the support bar and the pinion gear form a rack-and-pinion drive. The pinion gear can engage the support bar 110 through a window in the tube 126.

Also shown in FIG. 5, is an open bottom, sheet-metal compartment or isolation chamber 160 that can be provided within the flared portion 58 which is shaped to closely receive the microwave oven 52 when the microwave oven 52 is raised to fit within the flared portion 58. The compartment 160 will maintain the microwave relatively clean by protecting the outside of the microwave oven 52 from any grease carried by the exhaust gases passing around the microwave oven 52.

The exhaust gases are indicated by arrows in FIG. 5 and are shown to be drawn up through the flared portion 58 on either side of the compartment 160 and up into the duct 56 to be exhausted outside the house or building. The exhaust fan 60 draws exhaust gases up through the flared portion 58, up through the duct 56 and out of the house or building.

Figure 6:
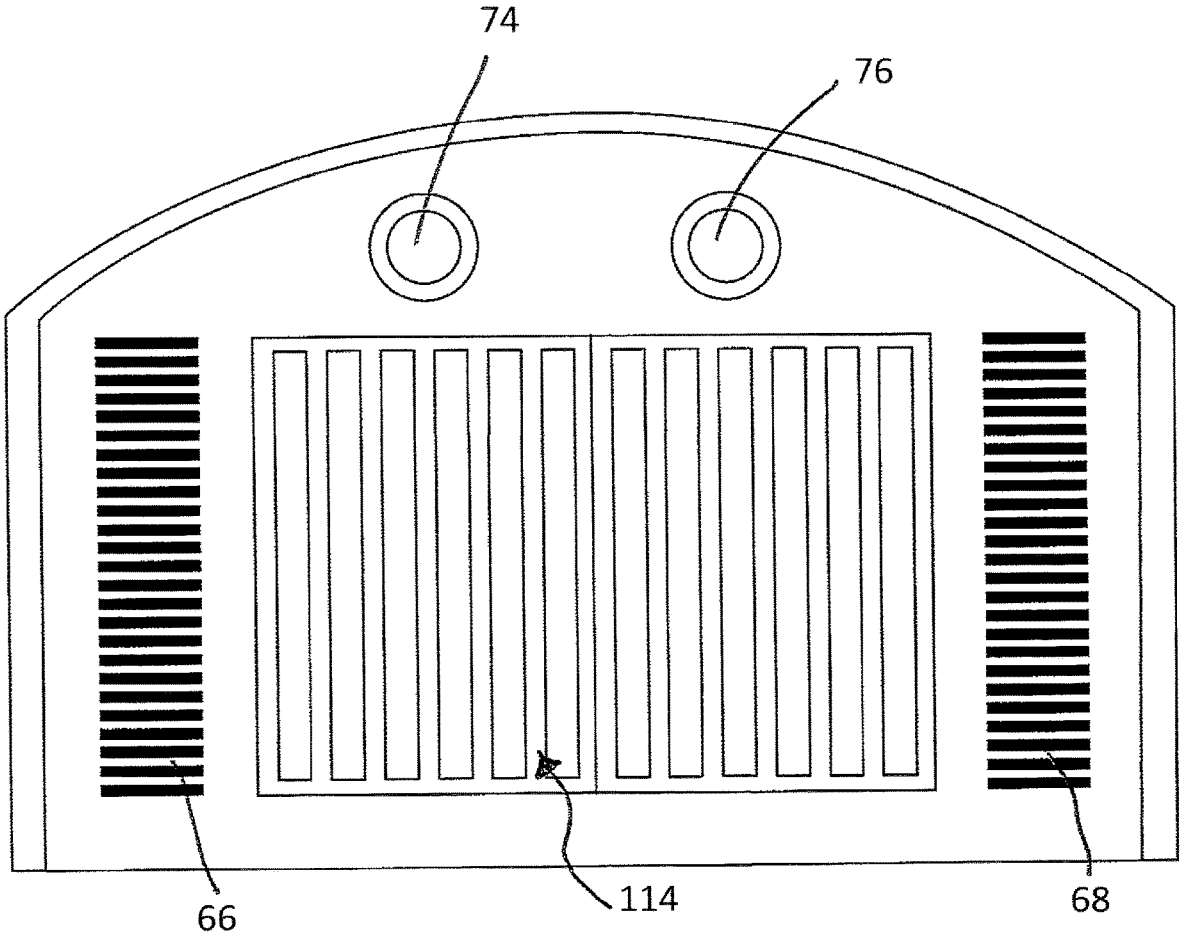
FIG. 6 is a bottom view of the first embodiment of FIG. 2, shown in a raised position.
Figure 6A:
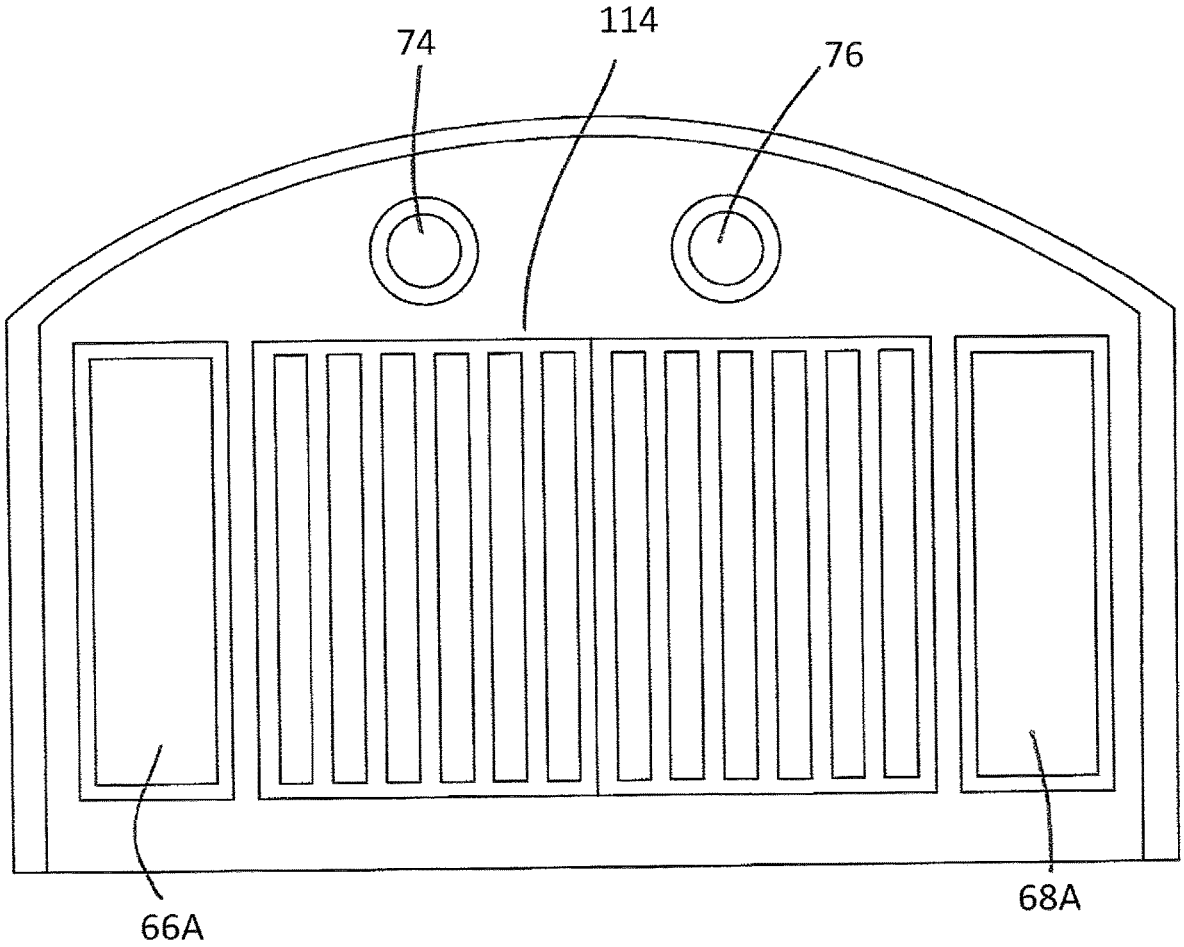
FIG. 6A is an alternate bottom view of the first embodiment combination lifting-mechanism and range-hood of FIG. 2, shown in a raised position.

FIG. 6 illustrates a bottom view of the combination 40.

Figure 7:
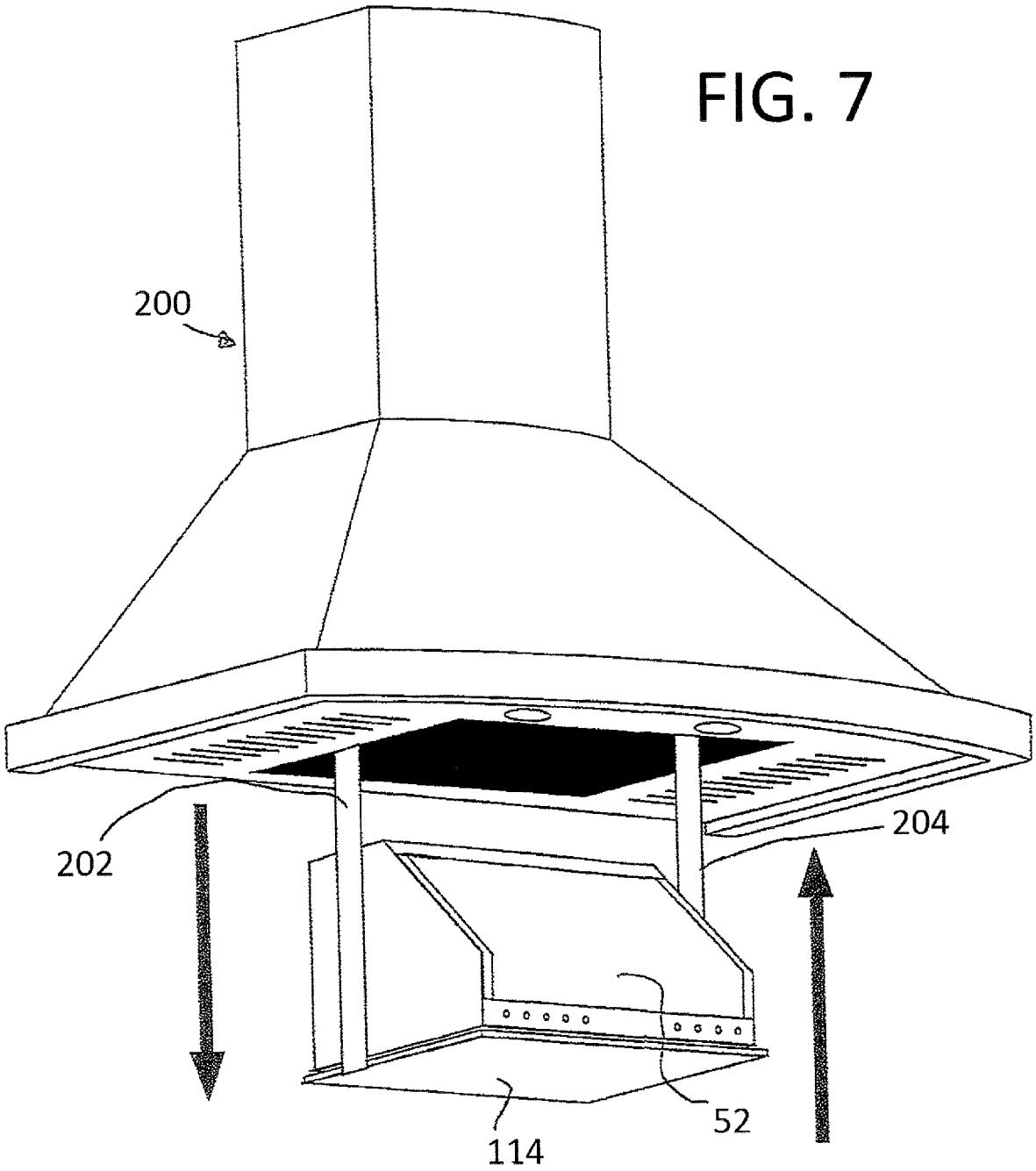
FIG. 7 is a schematic perspective view of a second embodiment combination lifting-mechanism and range-hood of the invention.

FIG. 7 illustrates a second embodiment combination lifting-mechanism and range-hood 200. In this embodiment, two support rods or bars 202, 204 are arranged on opposite sides of the support plate 114, attached to the support plate 114. Unless otherwise indicated, the combination 200 is identical to the combination 40.

Figure 8:
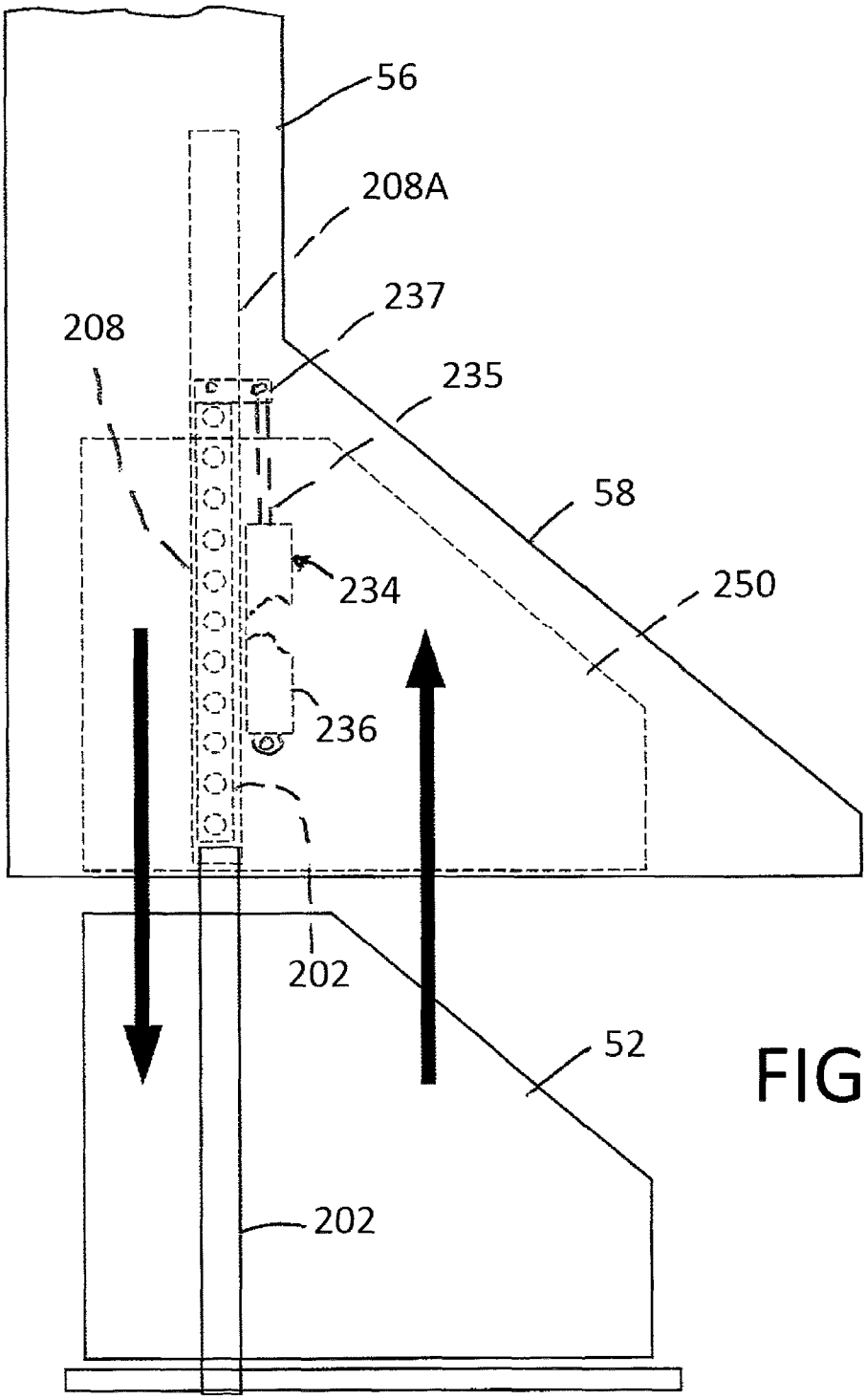
FIG. 8 a schematic side view of the second embodiment of FIG. 7.

FIG. 8 illustrates that the support bars 202, 204, when the microwave oven 52 is raised, slide through rectangular tubes 208, one on each side of the microwave oven 52 within the flared portion 58, and the duct 56 as needed. Only one rectangular tube 208 is shown with the understanding that the other rectangular tube is directly behind the rectangular tube 208 shown in FIG. 8. The rectangular tubes 208 protect the bars 202, 204 from grease carried in the exhaust gases. For stability of operation, a slide rail type bearing can be used inside of each tube 208 to ensure smooth up and down movement of the support bars 202, 204 and the equipment they lift.

FIG. 8 shows a further type of lifting mechanism 234 in the form of a pneumatic or hydraulic cylinder or a screw-drive, a circulating belt or chain, or other known linear actuator.

If the lifting mechanism 234 is a pneumatic cylinder, as more fully described in FIG. 14, when the lifting mechanism is actuated, to lift the microwave up, the cylinder 234 is elongated with a cylinder rod 235 driven upward out of a cylinder portion 236 to drive connected to the bars 202, 204, via a link 237, upward. The link 237 can pass vertically along the tube 208 through a side slot 208A. A dashed outline 250 is shown within the flared portion 58 which represents the space to be occupied by the microwave 52 when it is raised up completely into the flared portion 58, to be horizontally concealed, i.e., the bottom of the microwave oven being still visible from beneath.

The microwave oven 52 can be simply supported by resting on the support plate 114, or can be fastened to the plate 114.

Figure 9:
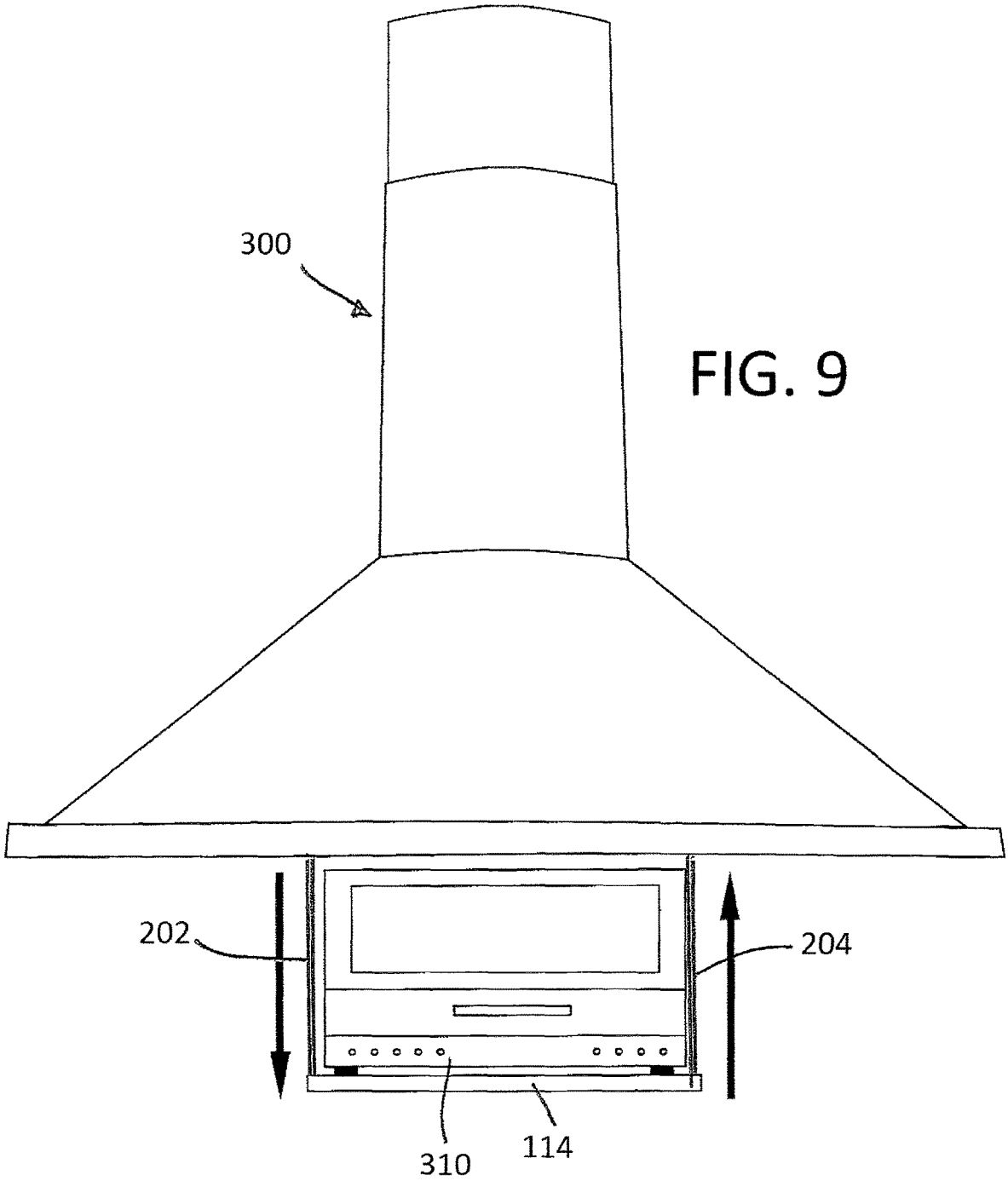
FIG. 9 is a schematic front view of a third embodiment combination lifting-mechanism and range-hood of the invention.

FIG. 9 illustrates a third embodiment combination lifting-mechanism and range-hood 300. In this embodiment a conventionally shaped rectangular box-shaped microwave 310 is supported on the plate 114 and raised and lowered by the support bars 202, 204. Unless otherwise indicated, the embodiment of FIG. 9 is identical to the combination 200 of FIGS. 7 and 8.

Figure 10:
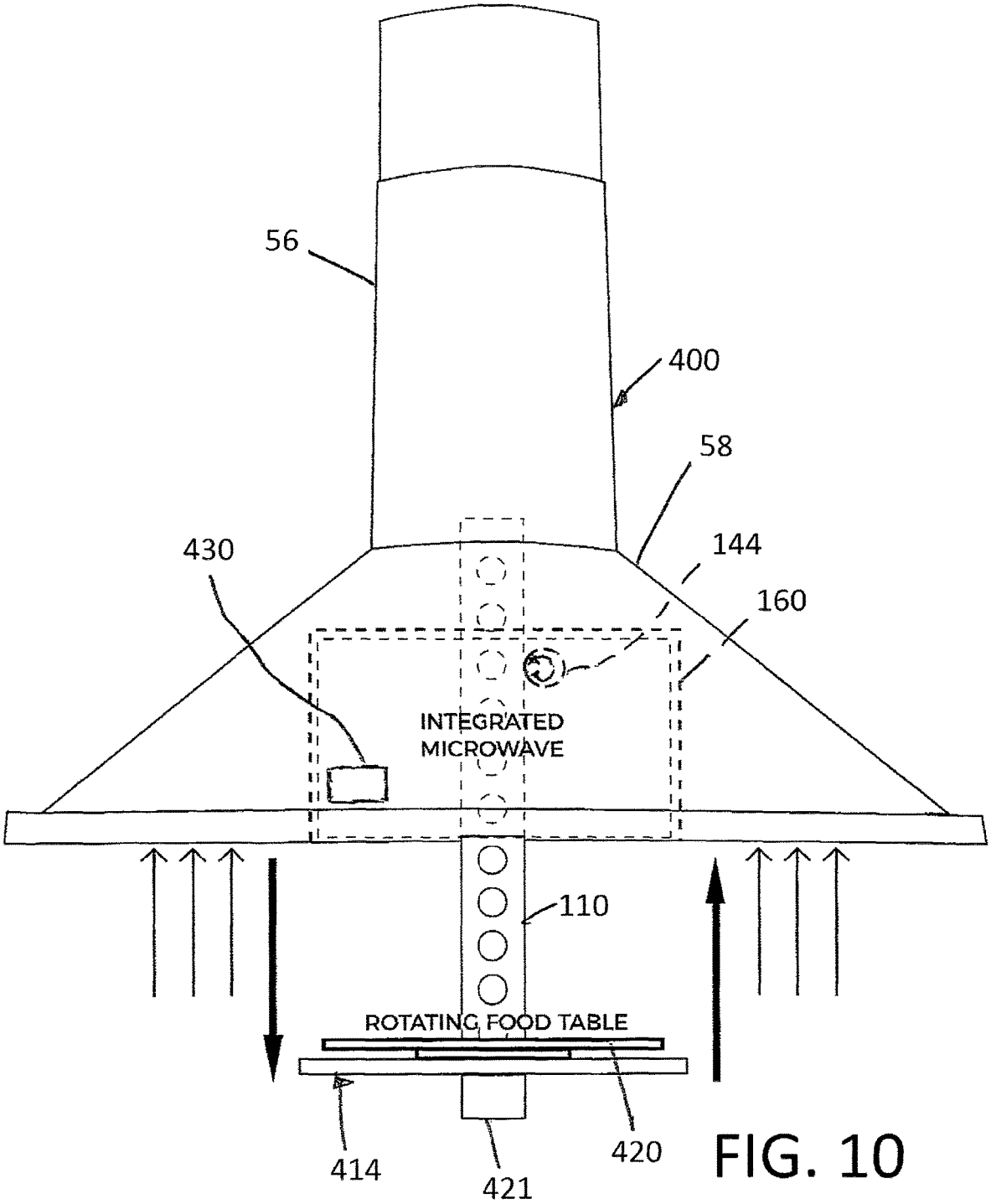
FIG. 10 is a schematic front view of a fourth embodiment combination lifting-mechanism and range-hood of the invention.
Figure 11:
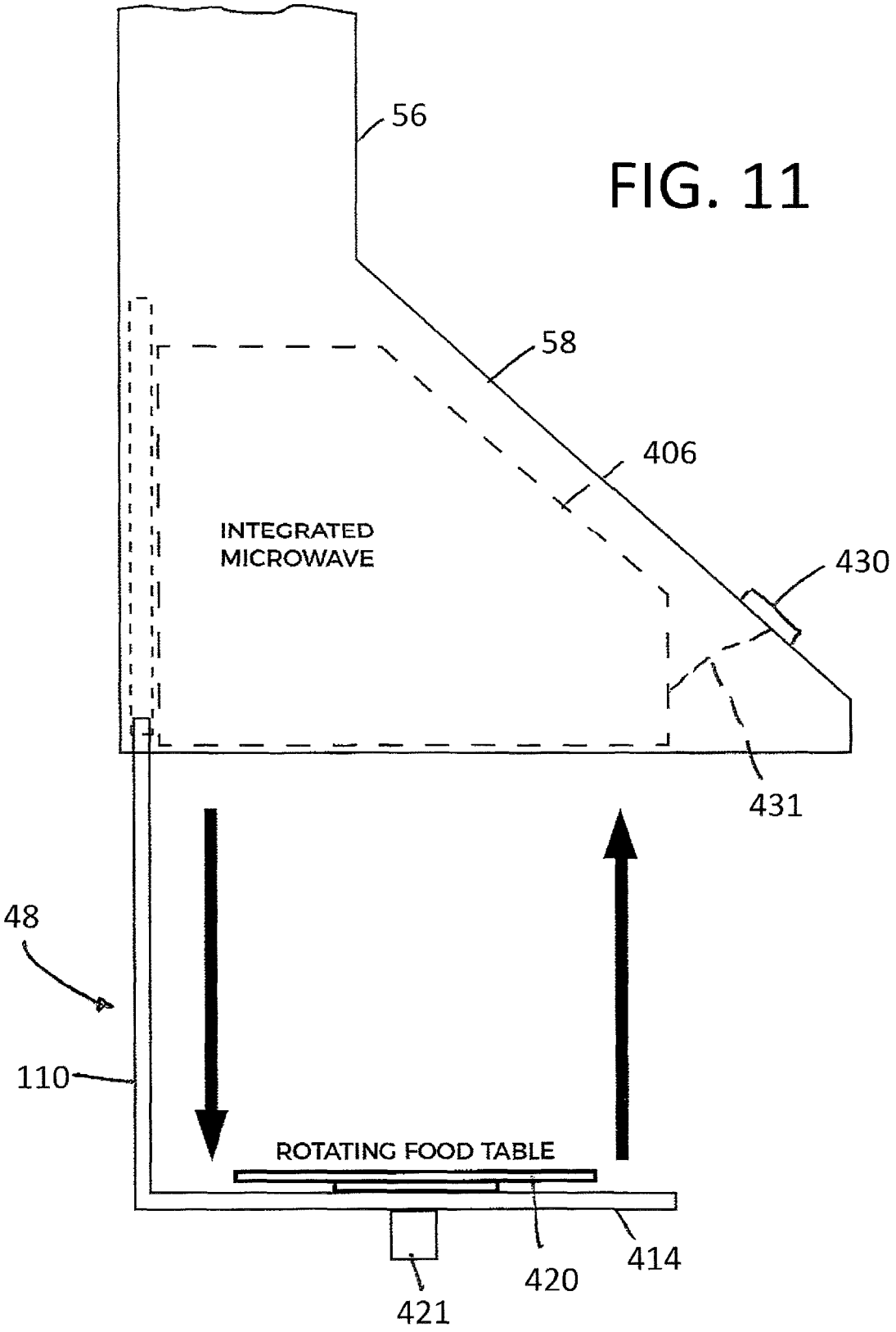
FIG. 11 is a schematic side view of the fourth embodiment of FIG. 10.

FIGS. 10 and 11 illustrate a fourth embodiment combination lifting-mechanism and range-hood 400 according to the invention. Unless otherwise indicated, the combination 400 of FIGS. 10 and 11 is identical to the first embodiment combination of FIGS. 2 through 6. In this fourth embodiment, a modified microwave oven 406 is employed. This microwave oven 406 is substantially integrated into the flared portion 58 of the hood 44. The microwave oven 406 is open for loading food by a displaceable bottom floor 414 as effectually the "door" of the microwave oven. The floor 414 includes the rotating food platter 420 and a motor 421 for its rotation. In operation, the support bar 110 is lowered from the flared portion 58 to load food onto the rotating food platter. Then, a lifting mechanism 48, such as by using the pinion gear 144 and the teeth along the bar 110, raises the support bar 110 and the bottom floor 414 until the bottom floor seals against the otherwise open bottom of the microwave oven 406. Microwave controls 430, communicating to the microwave oven via a cable 431, can be integrated into a front surface of the hood portion 58. In this embodiment, only the bottom floor 414 of the microwave oven 406 is raised and lowered while the remainder of the microwave oven 406 is fixed in place into the flared portion 58.

FIGS. 12-15 illustrate some powered lifting mechanisms pertaining to some embodiments, it should be understood that any of the lifting mechanisms, including the rack and pinion lifting arrangement shown in FIG. 5, could be used in any of the herein described combination lifting-mechanism and range-hood embodiments. Additionally, the powered lifting mechanisms, including electrical, pneumatic or hydraulic, would be provided with a power source, such as domestic electric power or a source of pneumatic or hydraulic pressure fluid, and a control panel on the hood for the user to operate the lifting mechanism.

FIG. 12 illustrates a scissor jack lifting mechanism 480 that could be configured to lift the microwave oven 52. The jack 480 is connected to the hood by a link 481 connected to a lug 483 fixed to the hood 44. By operation of a threaded rod 482 driven by a motor 486 the jack 480 is either elongated or retracted to lift support bars 110, 202, 204, depending on the embodiment.

FIG. 13 illustrates a screw-drive mechanism 520 wherein a drive nut 526 is threaded onto a threaded rod 528 such that turning of the threaded rod 528 by a motor 530 causes the threaded nut 526, which cannot rotate with the rod, to raise and lower on the threaded rod 520. A link 536 is bolted by fasteners 540 to the threaded nut 526. The link 536 can be operatively attached to the support bars 110, 202, 204 to raise and lower the support plate 114 or the bottom floor 414 depending on the embodiment.

FIG. 14 illustrates a typical hydraulic or pneumatic cylinder 234. The cylinder has the stationary cylinder portion 236 that can be fastened via a lug 624 to the hood 44, and the extendable and retractable rod 235 that is either retracted into the cylinder portion 236 or extended out of the cylinder portion 236, given the direction of hydraulic or pneumatic pressure in the cylinder portion 236. The rod 235 includes a lug 628 at an end thereof to be operatively connected by the link 237 to the support bars 110, 202, 204 to raise or lower the support plate 114 or the bottom floor 414 depending on the embodiment.

FIG. 15 illustrates another lifting mechanism 700 which includes upper and lower pulleys or sprockets 706, 708 wrapped by a belt or chain 716. A motor 709 drives one of the sprockets or pulleys 706, 708 to circulates the belts or chain 716 in a desired direction which raises or lowers a link 724 that is connected to the belt or chain 716. Depending on the direction of circulation of the belt or chain 716, the link 724 either raises or lowers. The link 724 can be operably connected to the support bars 110, 202, 204 to raise or lower the support plate 114 or the bottom floor 414, depending on the embodiment.

Although the heretofore described embodiments describe powered lifting mechanisms, such as electrical, pneumatic or hydraulic, to lower or lift microwave ovens into hoods, it is also possible that the raising and lowering of the microwave oven is done manually with a lift assist such as a counterweight assist (similar to sash windows) or a spring assist (similar to manually lifted garage doors). The following examples would be applicable to all of the heretofore described embodiments, and not just the embodiments in the examples.

Figure 16:
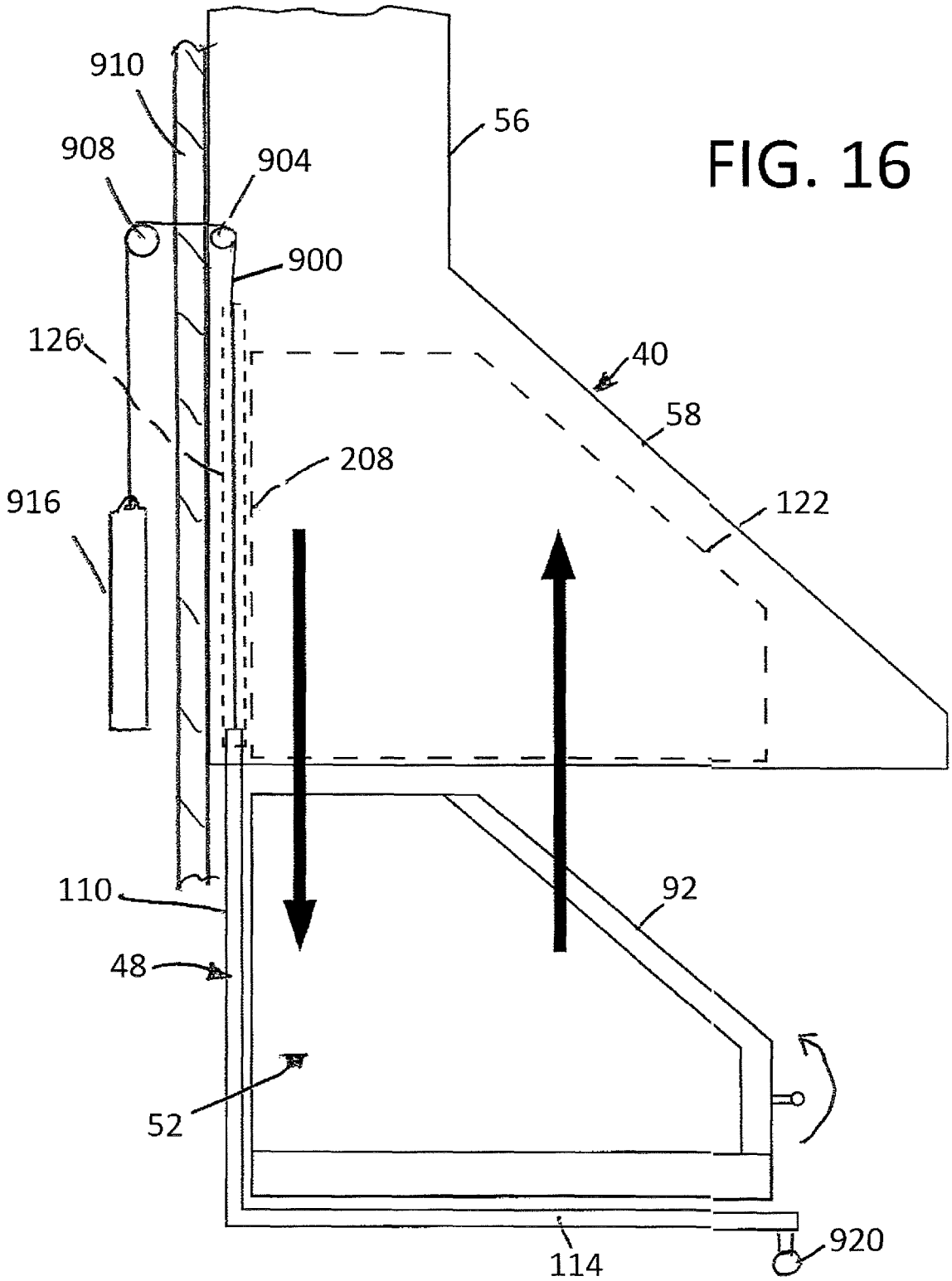
FIG. 16 is a schematic side view of a fifth embodiment combination lifting-mechanism and range-hood.

FIG. 16 illustrates a counterweight method, wherein the support bar 110, or bars 202, 204, depending on the embodiment, are connected to a cable 900 that partially wraps around a first pulley 904 inside the hood 44, and then exits the hood to be partially wrapped around a second pulley 908 which can be located on the other side of the room wall 910. The cable is then attached to a counterweight 916 which is selected of a weight to counterbalance the weight of the microwave oven and lifting apparatus so that little effort is required to manually pull down and lift the microwave oven and lifting apparatus by way of a handle 920.

Figure 17:
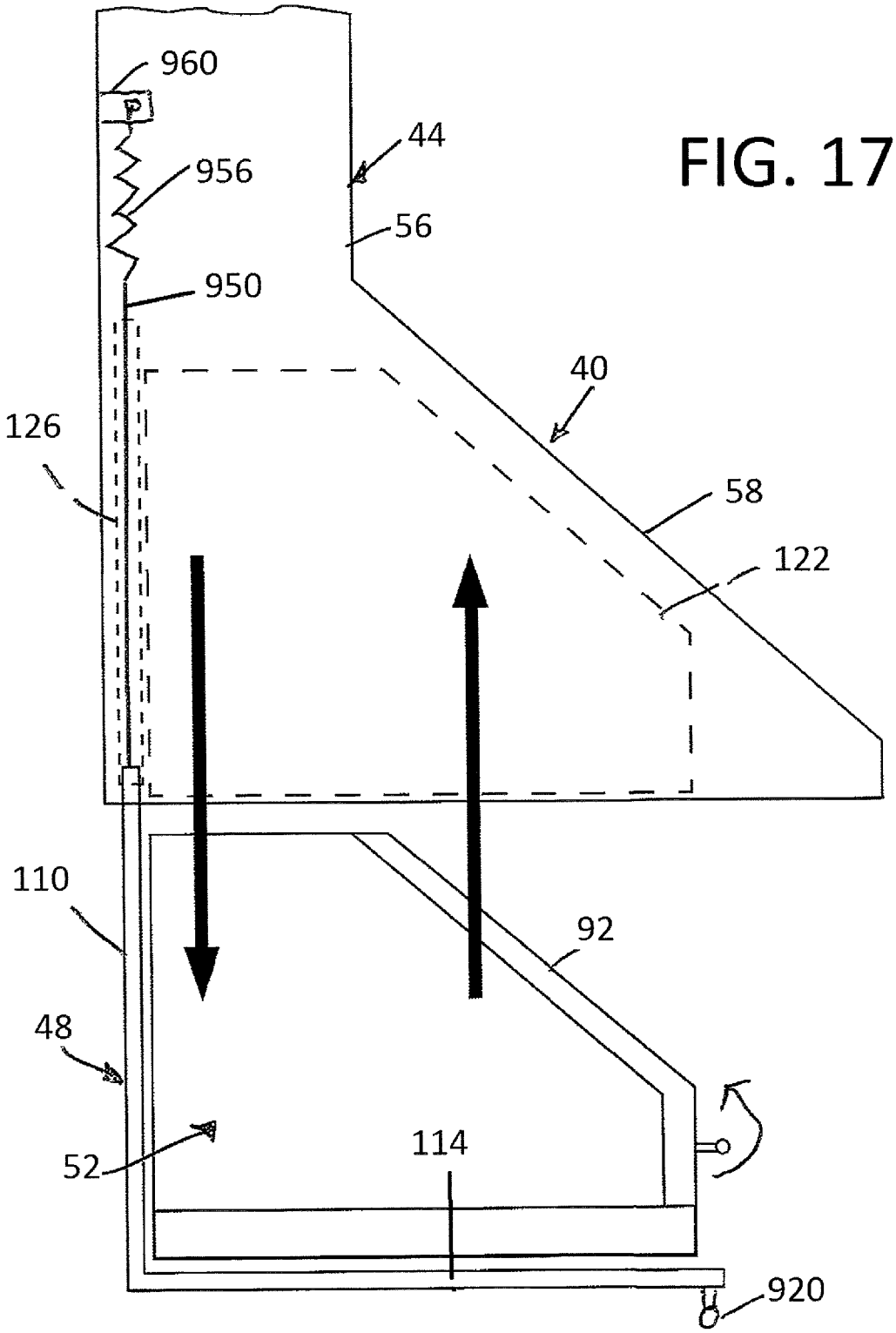
FIG. 17 is a schematic side view of a sixth embodiment of the combination lifting-mechanism and range-hood.
Figure 18:
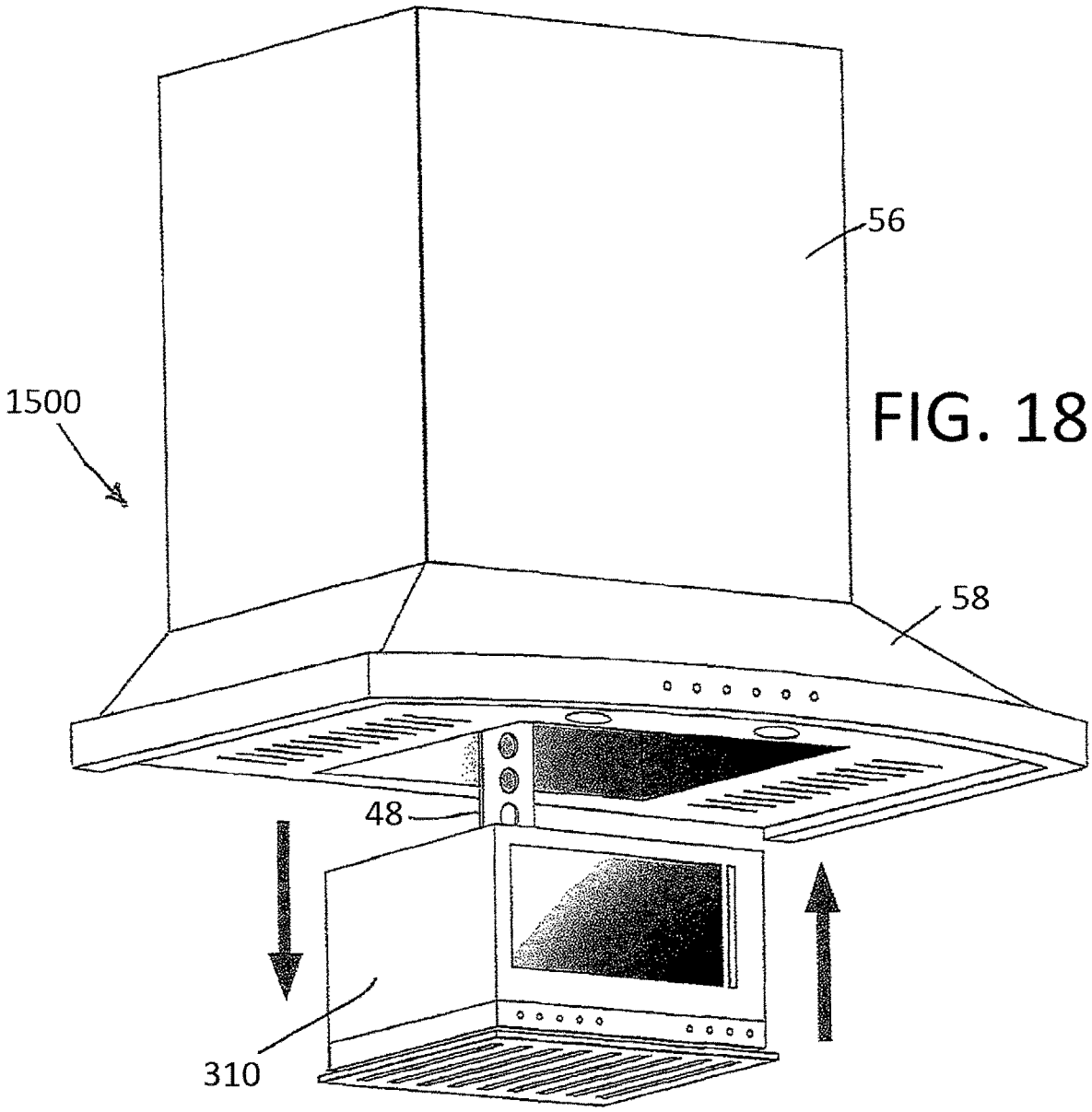
FIG. 18 is a schematic perspective view of a seventh embodiment combination lifting-mechanism and range-hood of the invention, with a microwave oven shown in a lowered position.
Figure 19:
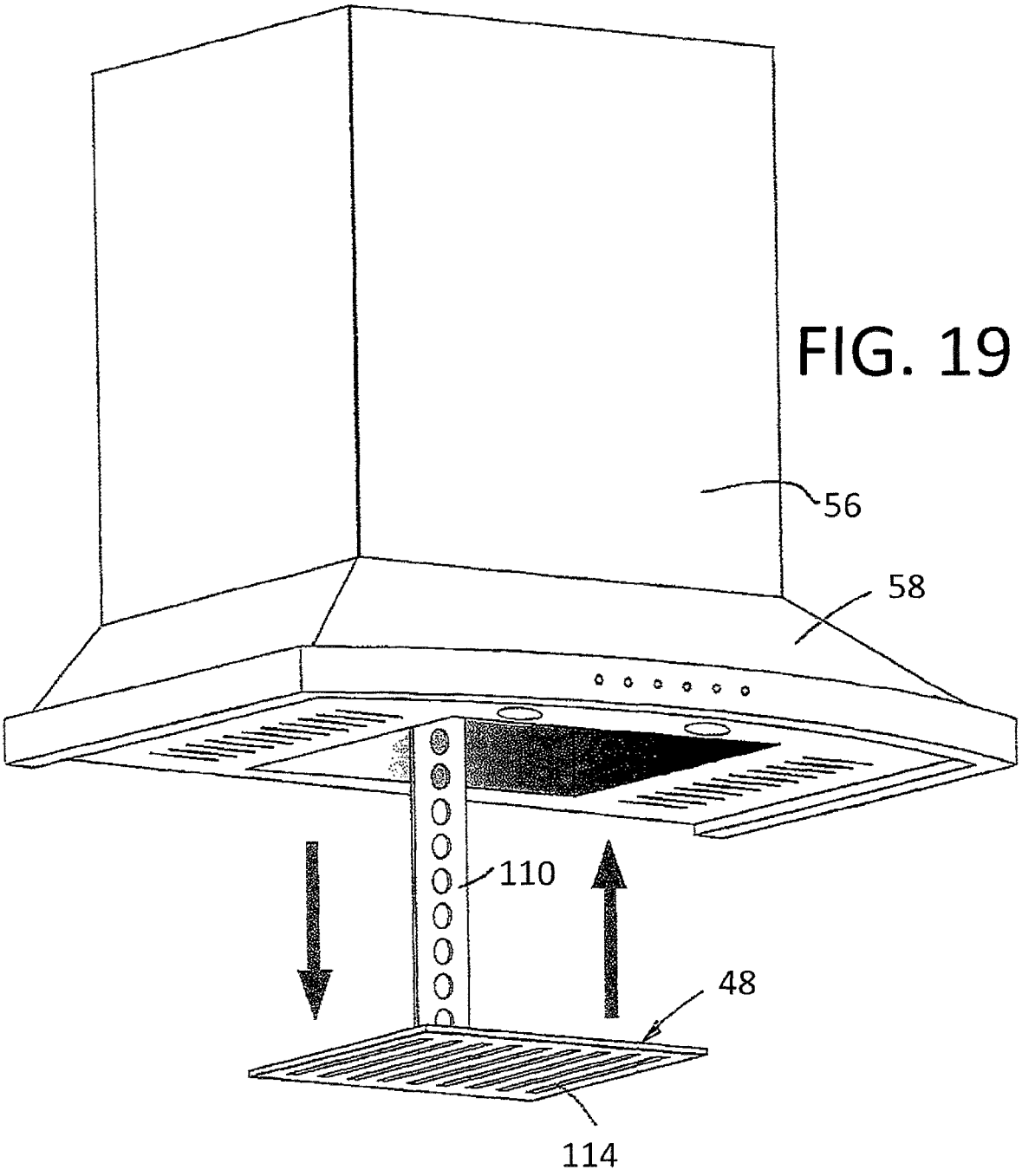
FIG. 19 is a schematic perspective view of the seventh embodiment of FIG. 18 with the microwave oven removed to see underlying parts.

FIG. 17 illustrates a counter spring method wherein a cable 950 is attached to the bar 110, or 202, 204, depending on the embodiment, and extends upward. The cable is attached to a coiled counter spring 956 which extends up to be attached by a lug 960 to the hood 44. The spring constant of the spring is selected such that it counterbalances the weight of the microwave oven and lifting apparatus so that little effort is required to manually pull down and lift the microwave oven and lifting apparatus by way of the handle 920. Although a coil spring is illustrated, different types of springs such as a torsion spring, could be used. A hydraulic dampener could also be used with the spring to provide for smooth lowering and raising.

Although the embodiments of the invention described above show lifting mechanisms that work above the microwave oven, it is encompassed by the invention that the lifting mechanism could lift the microwave oven from below.

Figure 20:
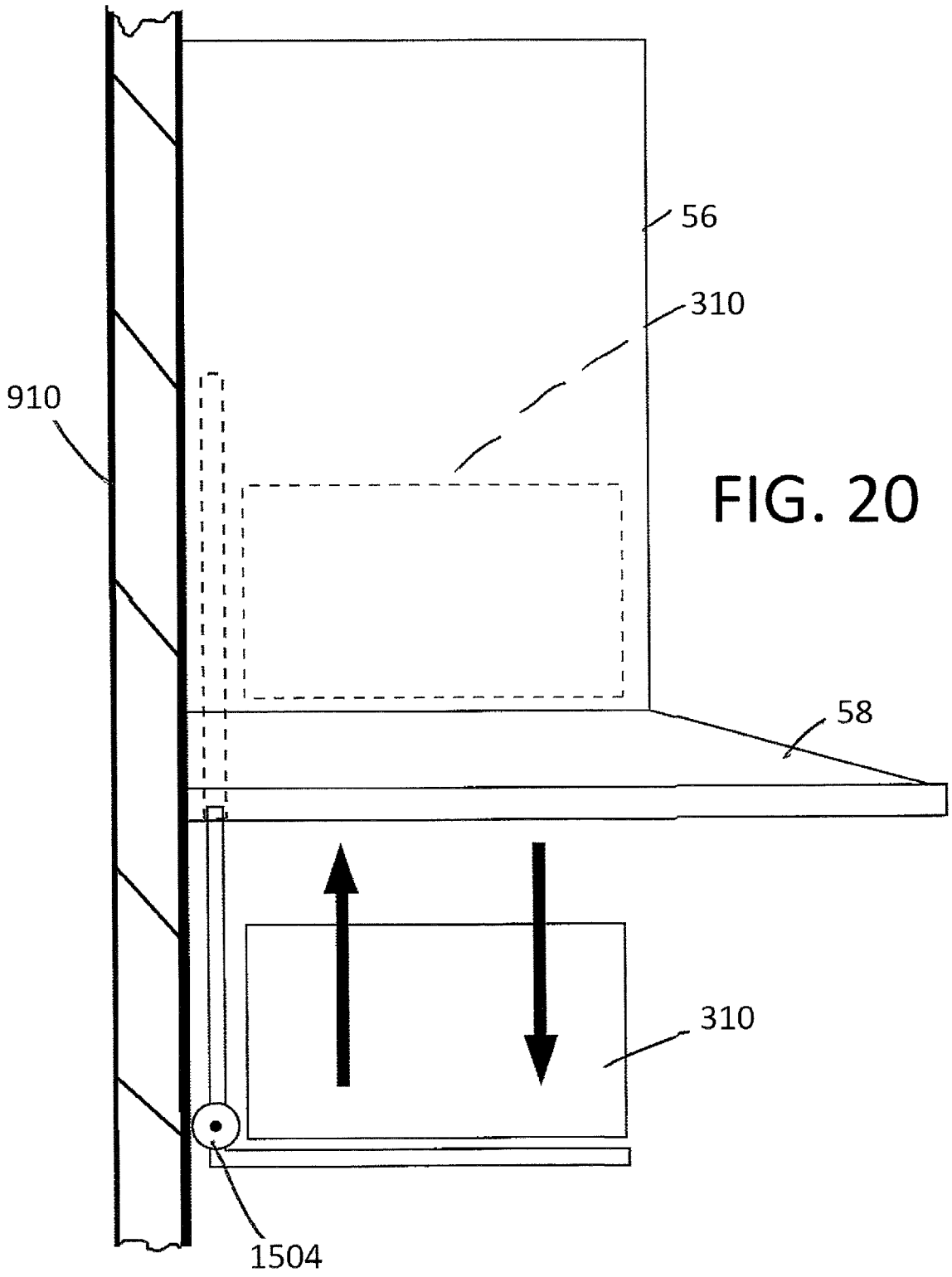
FIG. 20 is a schematic side view of the seventh embodiment of FIG. 18, with the microwave oven shown in a lowered position.
Figure 21:
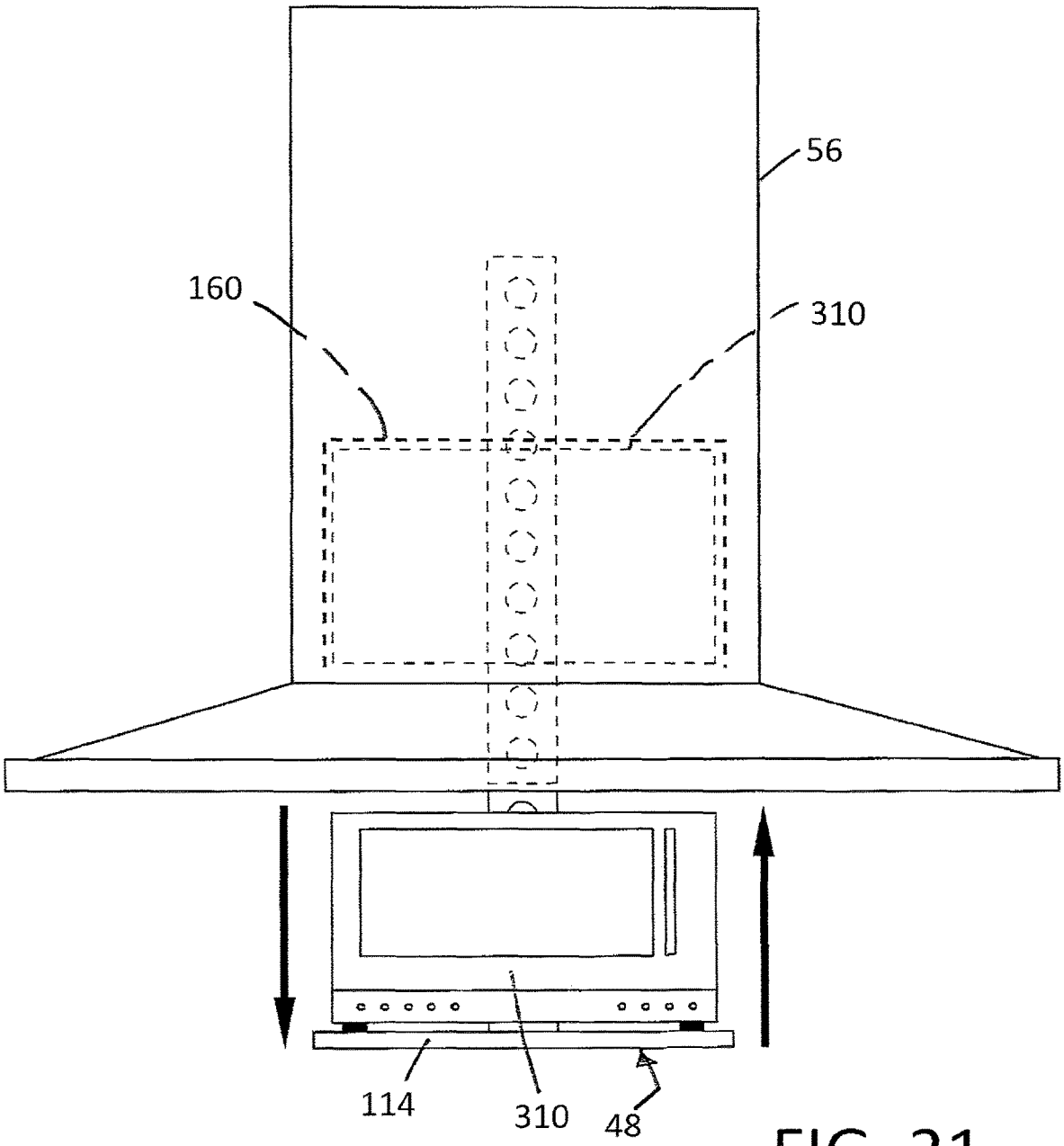
FIG. 21 is a schematic front view of the seventh embodiment of FIG. 18.

FIGS. 18-21 illustrate an alternate embodiment combination lifting-mechanism and range-hood 1500 similar to the embodiment 40 shown in FIG. 2 except as noted. In this embodiment, the flared hood portion 58 has a lesser vertical dimension and the duct 56 has a wider and deeper dimension. In this embodiment the microwave oven 310 has a conventional rectangular box shape. As shown in FIG. 20, the duct 56 has substantial transverse dimensions such that the microwave oven 310 (shown dashed) can be lifted up into the duct 56, instead of just into the flared portion 58.

Furthermore, the bar 110 can be braced against the room wall 910, or tile applied to the room wall, by a guide wheel 1504 that can roll against the wall 910. The guide when is rotatably mounted to the bar 110.

Figure 22:
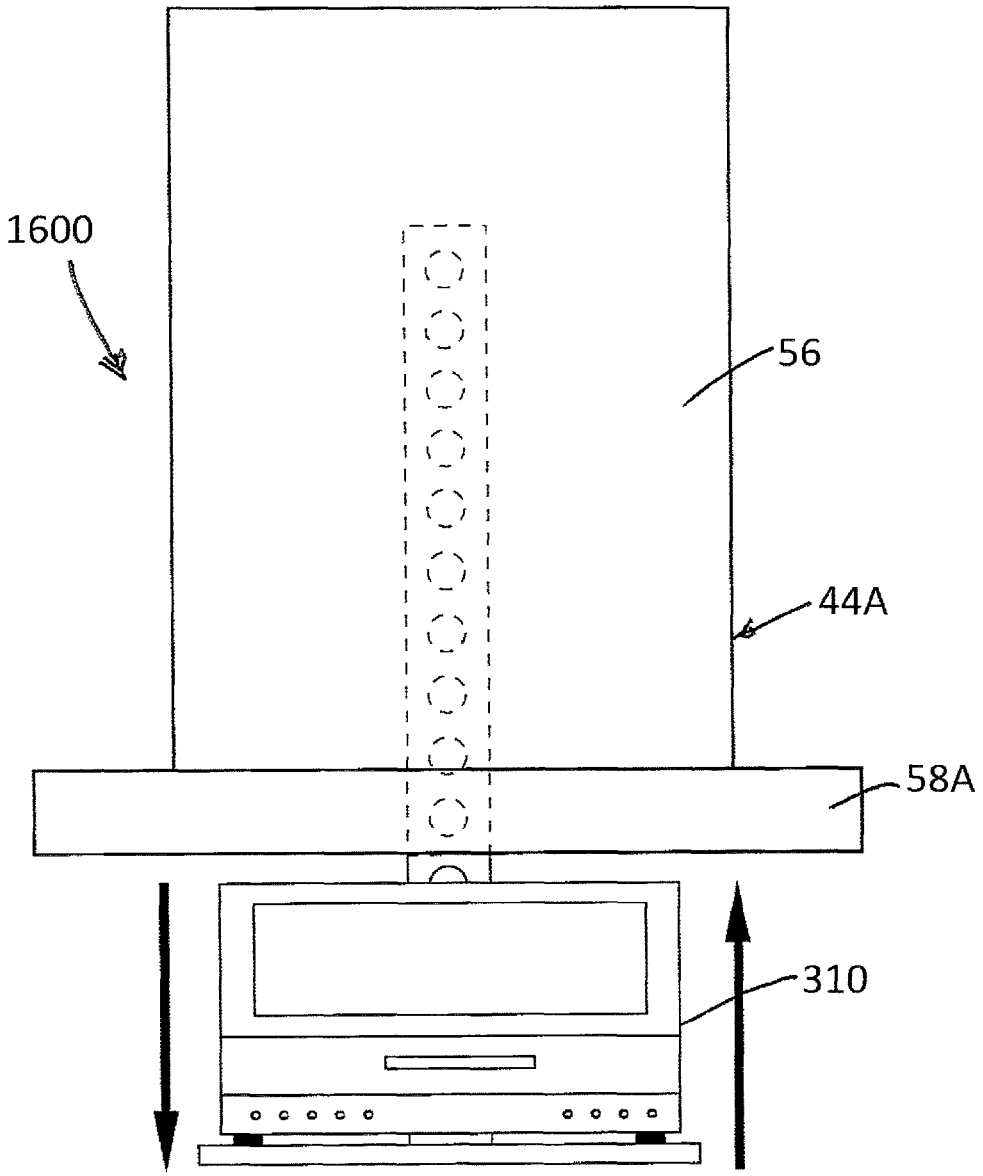
FIG. 22 is a schematic front view of an eighth embodiment combination lifting-mechanism and range-hood.
Figure 23:
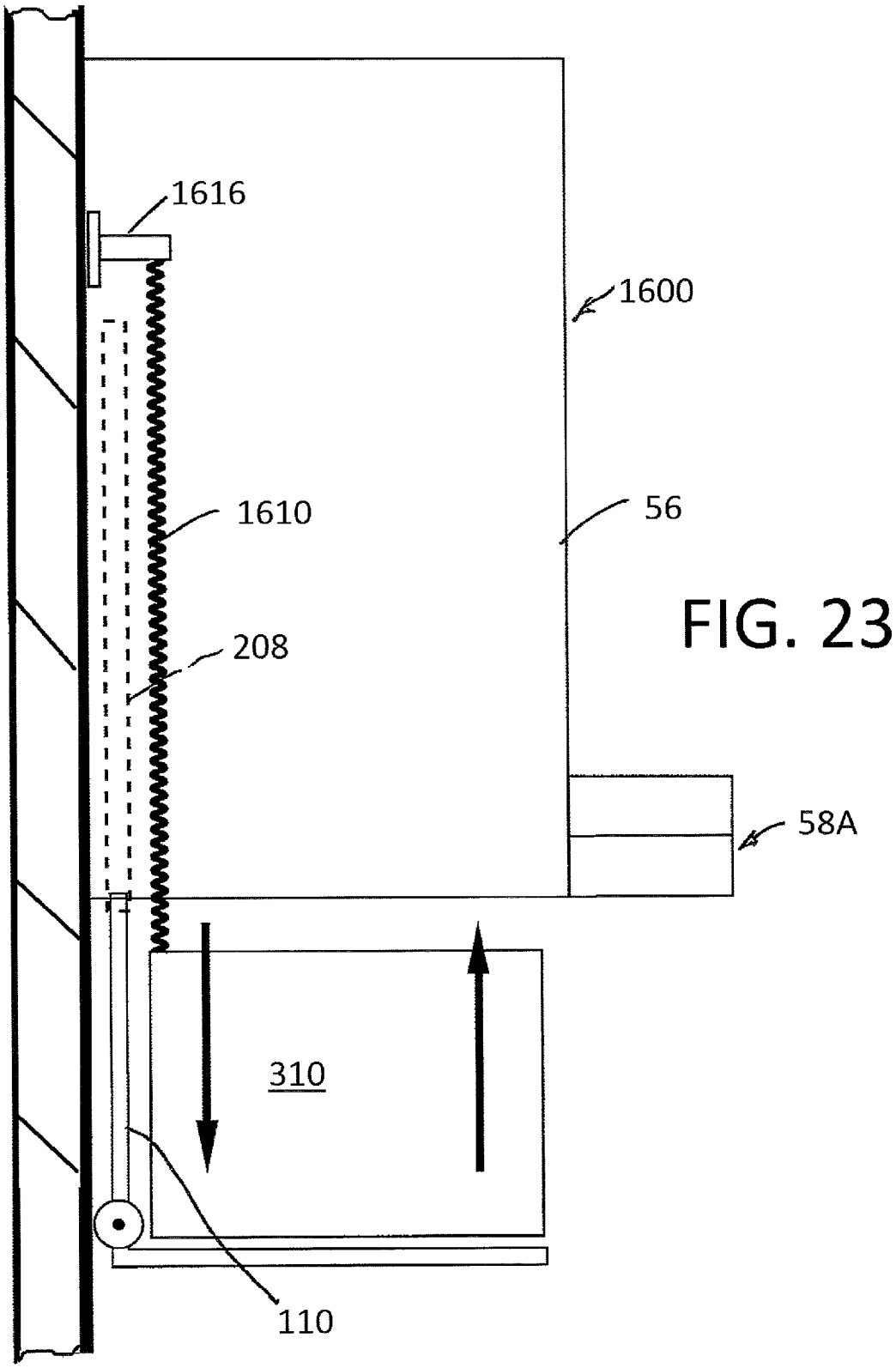
FIG. 23 is a schematic side view of the eighth embodiment of FIG. 22.
Figure 24:
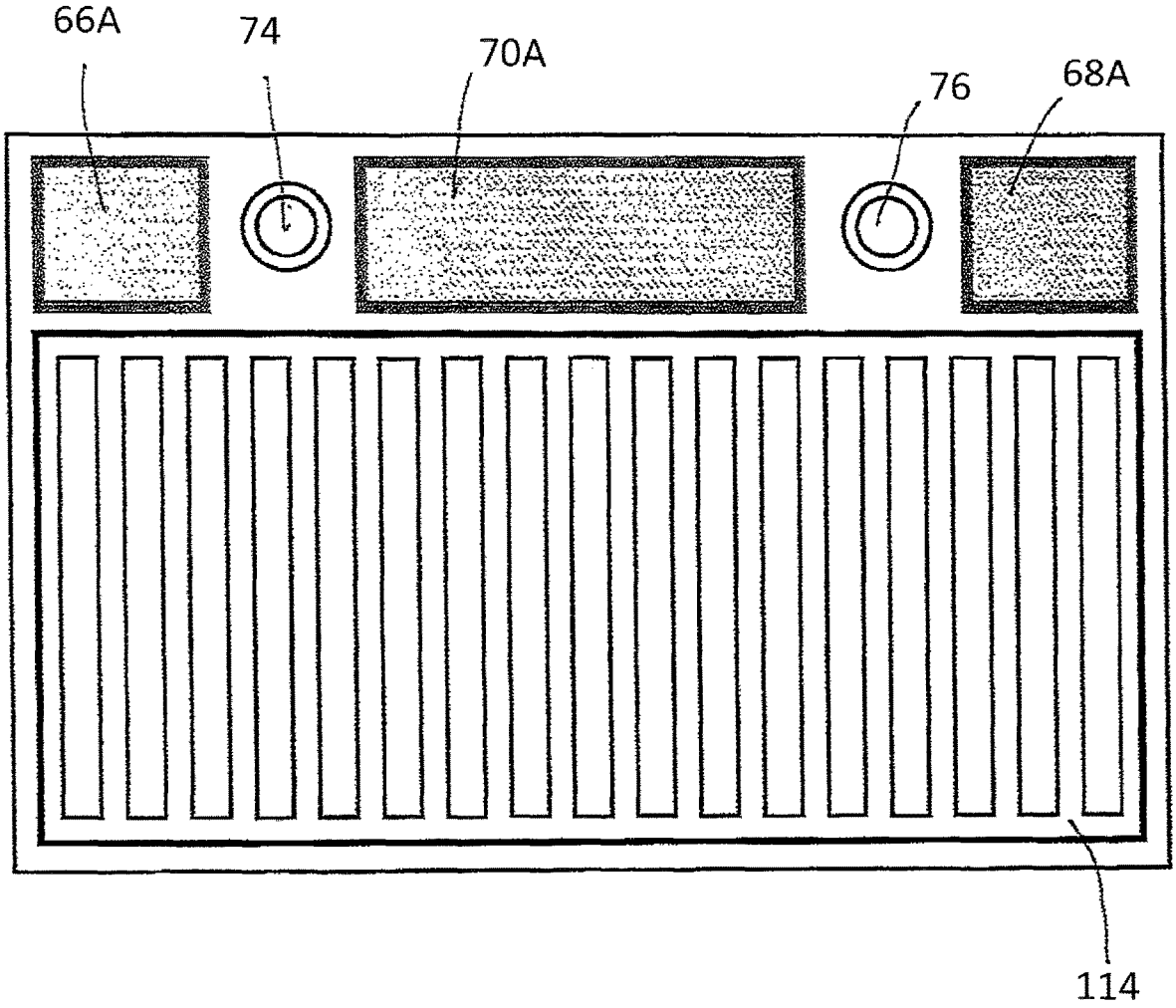
FIG. 24 is a bottom view of the eighth embodiment of FIG. 22.

FIGS. 22-24 illustrate a further alternate embodiment 1600 that includes a modified hood 44A that includes a duct 56 having a substantial transverse area, sufficient to receive a microwave oven 310 therein when lifted, and a substantially flat hood portion 58A that extends in front of the duct 56. As shown in FIG. 23, the microwave oven 310 can be powered by a coiled power cord 1610 inside the duct 56 that receives domestic electric power through a conduit or junction box 1616 that is powered through a wall penetration, also inside the duct 56. As shown in FIG. 24, the hood portion 58A carries the range lights 74, 76 as well as air/exhaust screens 66A, 68A, 70A. As previously stated, the screens 66A, 68A, 70A can be removed for cleaning or alternately can be permanent air openings.

Figure 25:
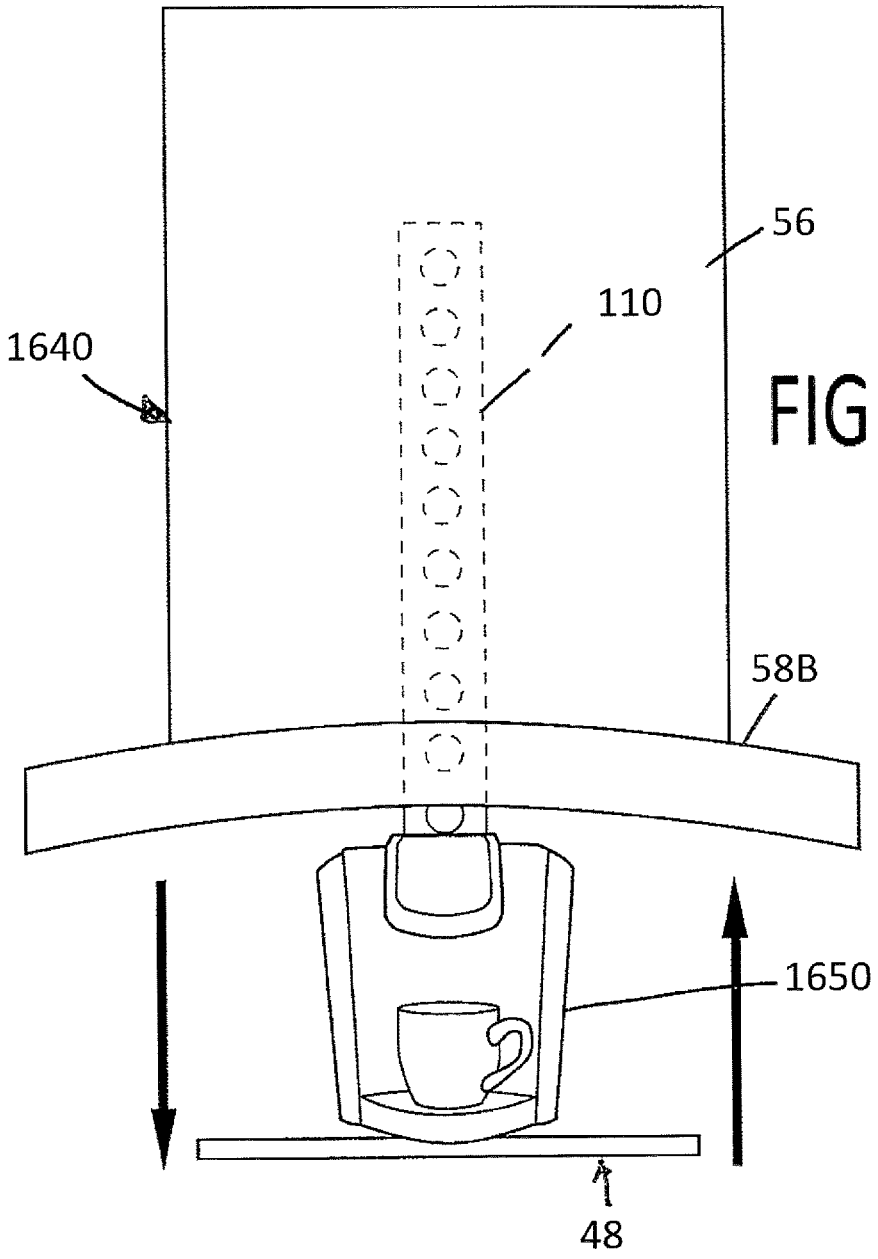
FIG. 25 is a schematic front view of a ninth embodiment combination lifting-mechanism, range-hood and coffee maker.

FIG. 25 illustrates an alternate embodiment 1640 wherein the lifting assembly 48 is used to lift a coffee maker 1650 up into the duct 56. A curved hood portion 58B is shown, similar to the portion 58A.

Figure 26:
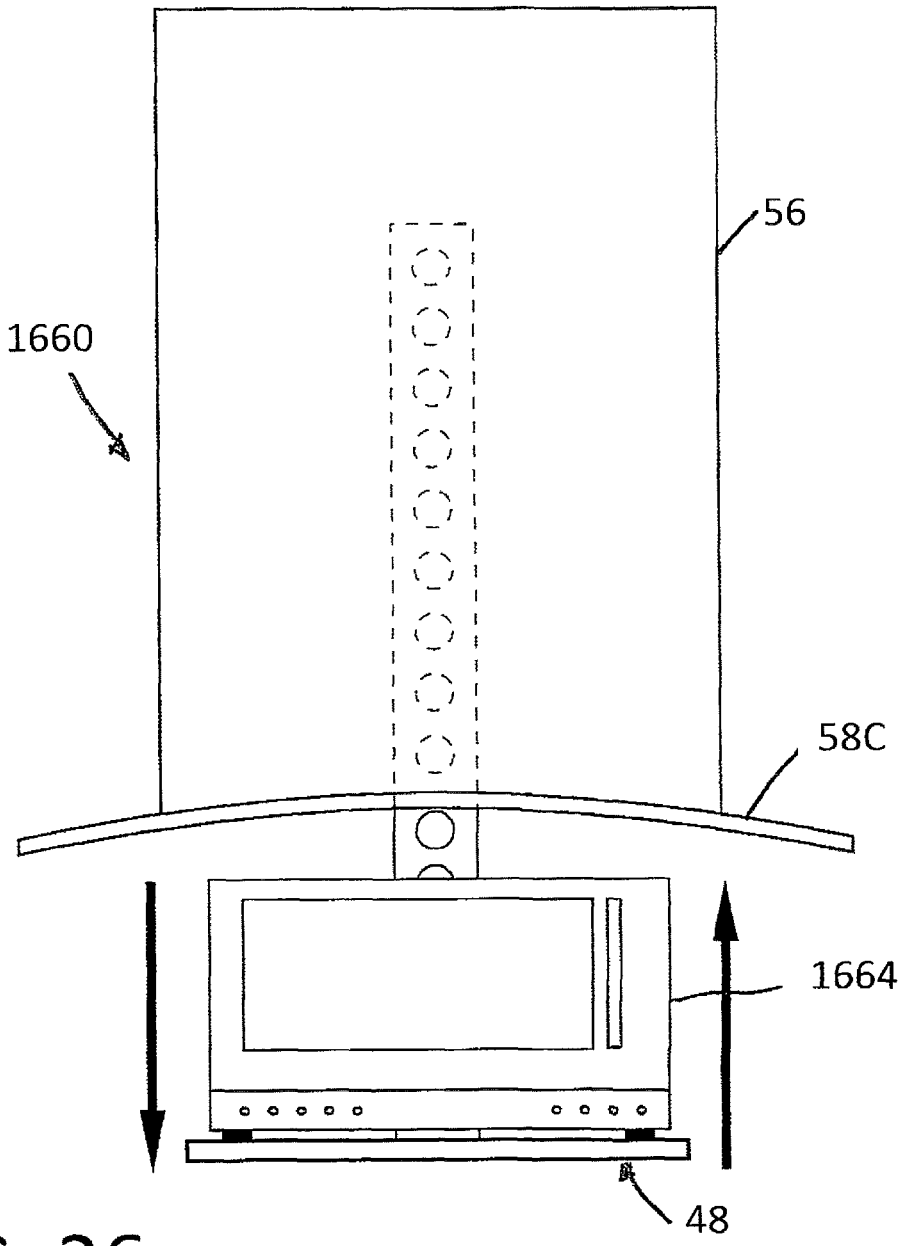
FIG. 26 is a schematic front view of a tenth embodiment combination lifting-mechanism, range-hood and toaster oven.

FIG. 26 illustrates an alternate embodiment 1660 wherein the lifting assembly 48 is used to lift a toaster oven 1664 up into the duct 56. A curved, plate-like hood portion 58C is shown, similar to the portion 58B.

Figure 27:
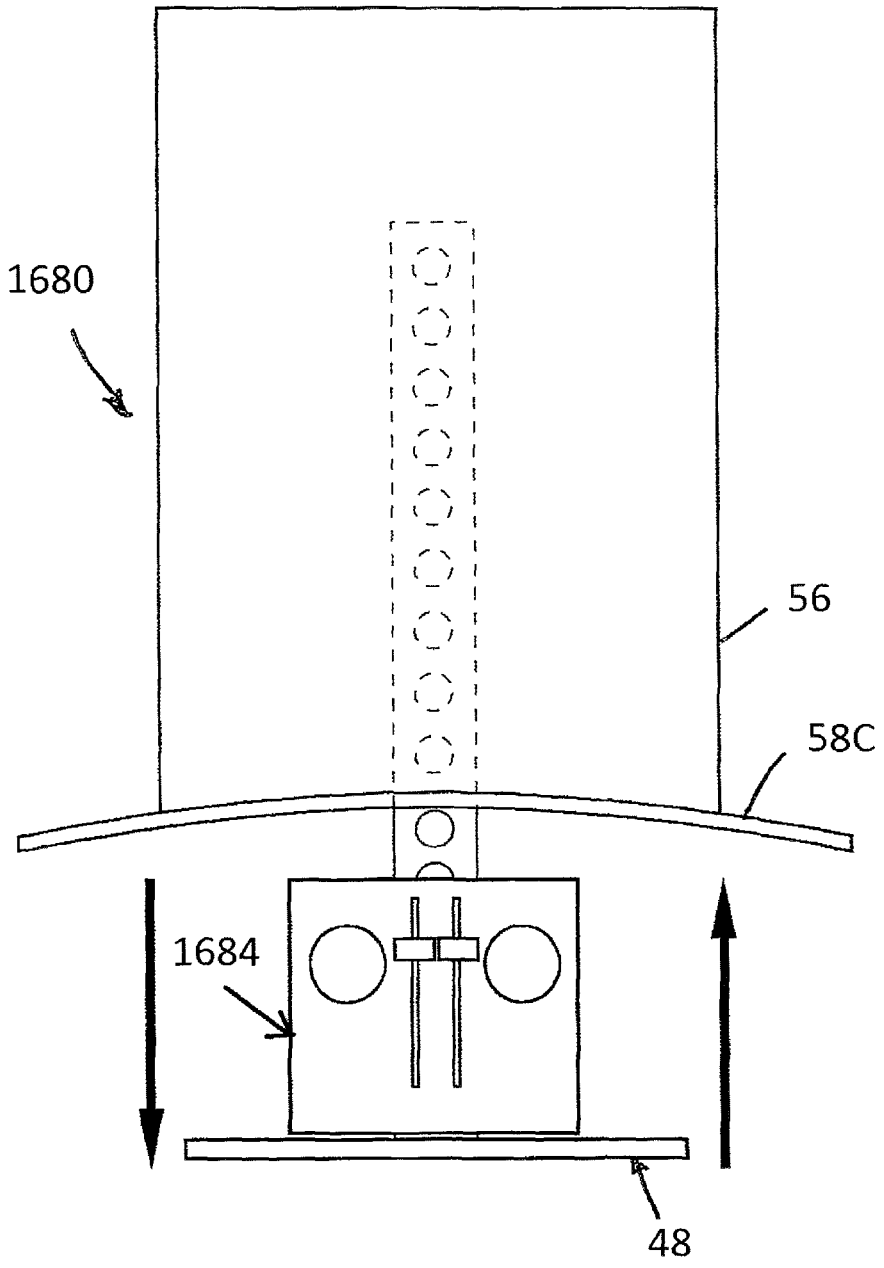
FIG. 27 is a schematic front view of an eleventh embodiment combination lifting-mechanism, range-hood and toaster oven.

FIG. 27 illustrates an alternate embodiment 1680 wherein a conventional toaster 1684 is raised by the lifting assembly 48 to be stored inside the duct 56.

Figure 28:
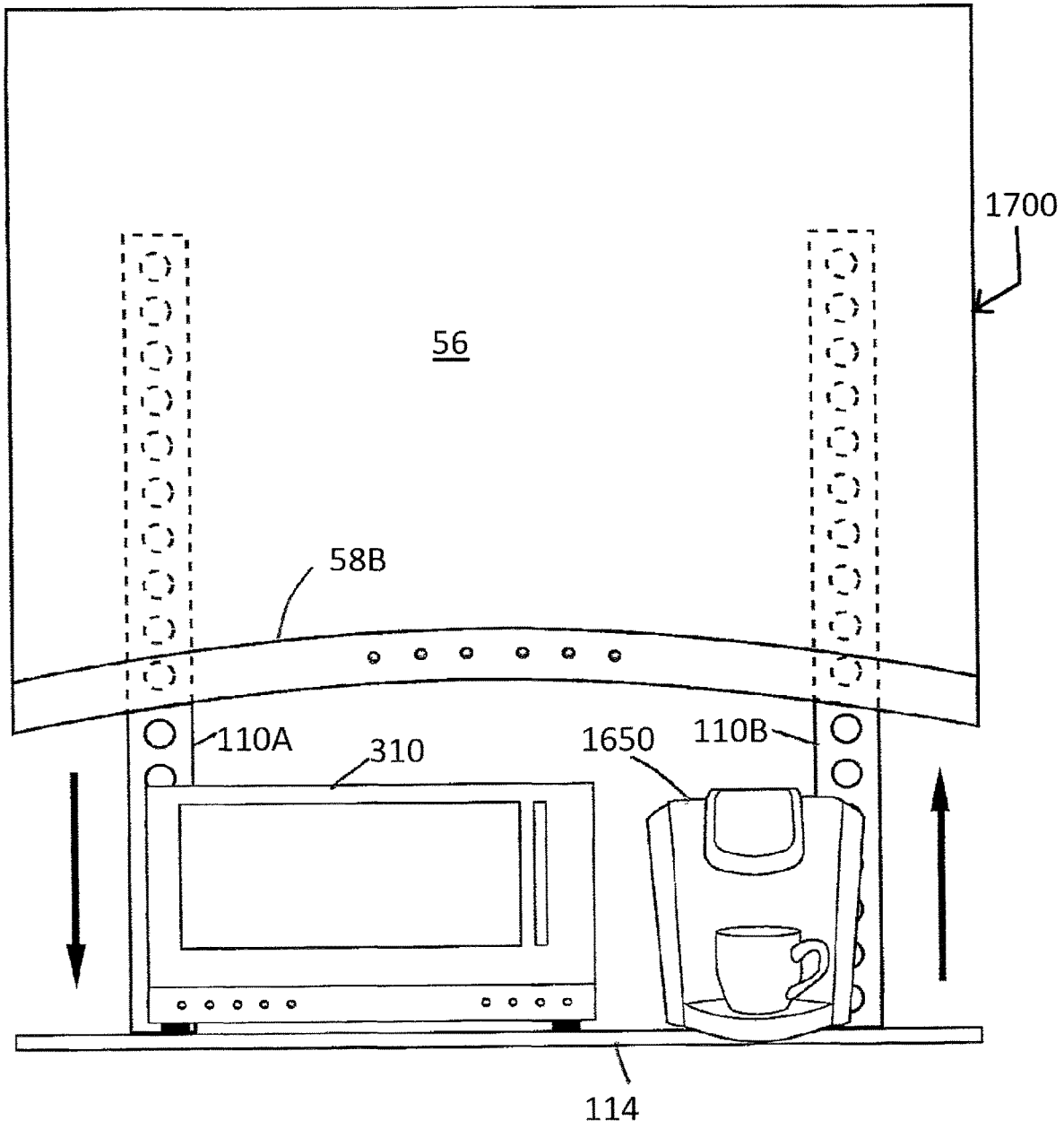
FIG. 28 is a schematic front view of a twelfth embodiment combination lifting-mechanism, range-hood and multiple appliances.

FIG. 28 illustrates an alternate embodiment 1700 wherein dual lift bars 110A, 110B lift the plate 114 of the lifting assembly 48A. Each bar 110A, 1108 can be configured, supported and guided as heretofore described for the bar 110. The plate 114 and the duct 56 are sufficiently deep and wide to support two appliances, such as the microwave 310 and the coffee maker 1650. Both appliances can be lifted for storage up inside the duct 56. The hood portion 58B provides the lights and screens or vents as previously described.

Figure 29:
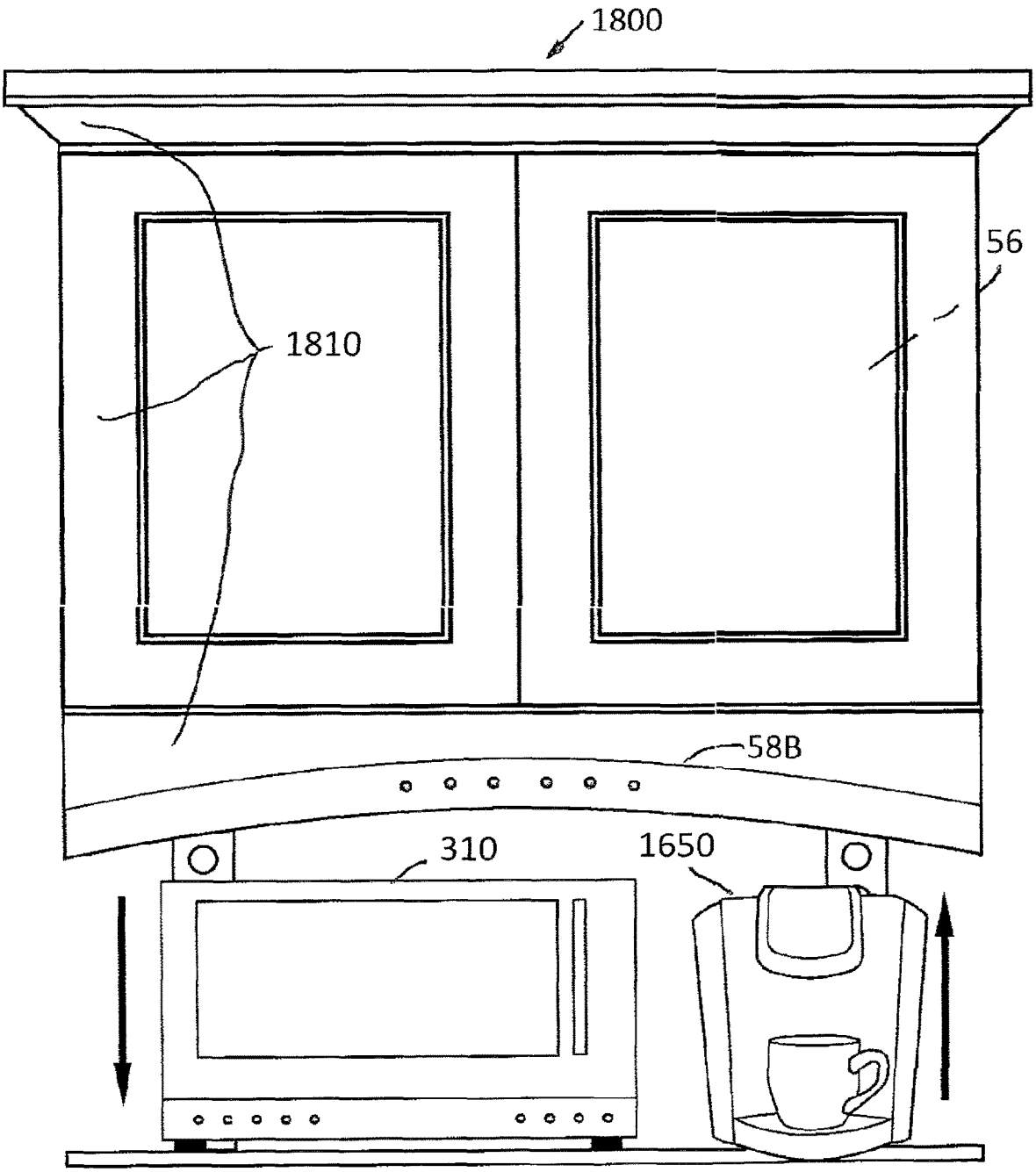
FIG. 29 is a schematic front view of a thirteenth embodiment combination lifting-mechanism, range-hood and multiple appliances.

FIG. 29 illustrates another embodiment 1800 that is similar to the embodiment of FIG. 28 except that the duct 56 (not visible) is covered by decorative wood or imitation wood panels 1810 that can match other kitchen cabinetry. The panels are typically attached to the underlying duct 56 by hook-and-loop fasteners (VELCRO) or other means.

Although the embodiment of FIG. 29 is illustrated as including a range hood including a duct 56, covered by panels, over a range, it is encompassed by the invention that the duct and decorative panels can be a simulated kitchen cabinet within the kitchen that does not function as a range hood. It need not be located over a cooking range. In this situation, the duct 56 with decorative panels 1810 forms a simulated cabinet that can receive small kitchen appliances lifted up into the duct 56 for storage. In this way, small appliances can be stored, hidden, and located above the kitchen counter below. This gives the user more working counter space and the ability to lower the small appliances from the duct only as needed.

Figure 30:
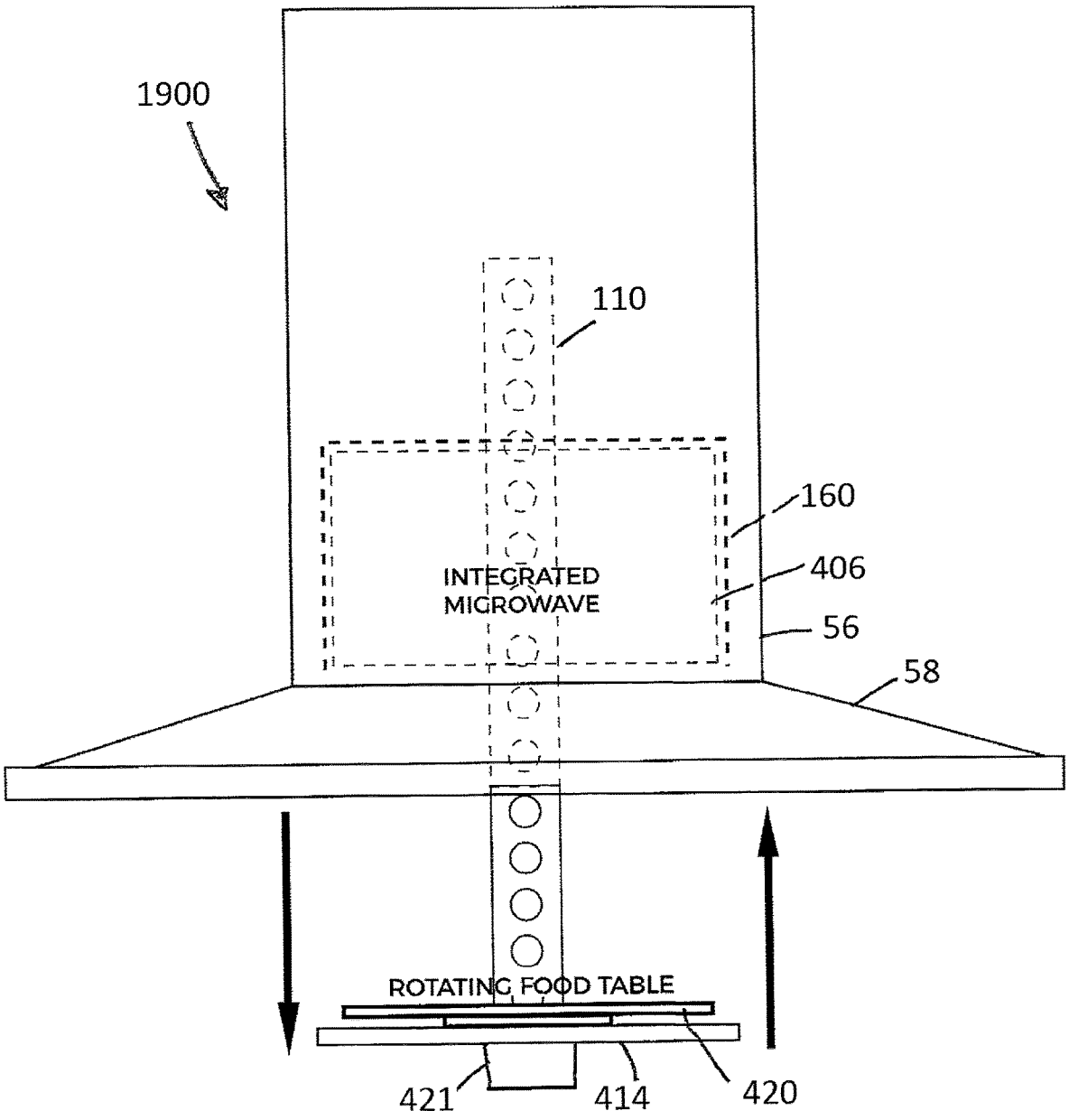
FIG. 30 is a schematic front view of a fourteenth embodiment combination lifting-mechanism, range-hood and microwave oven of the invention.
Figure 31:
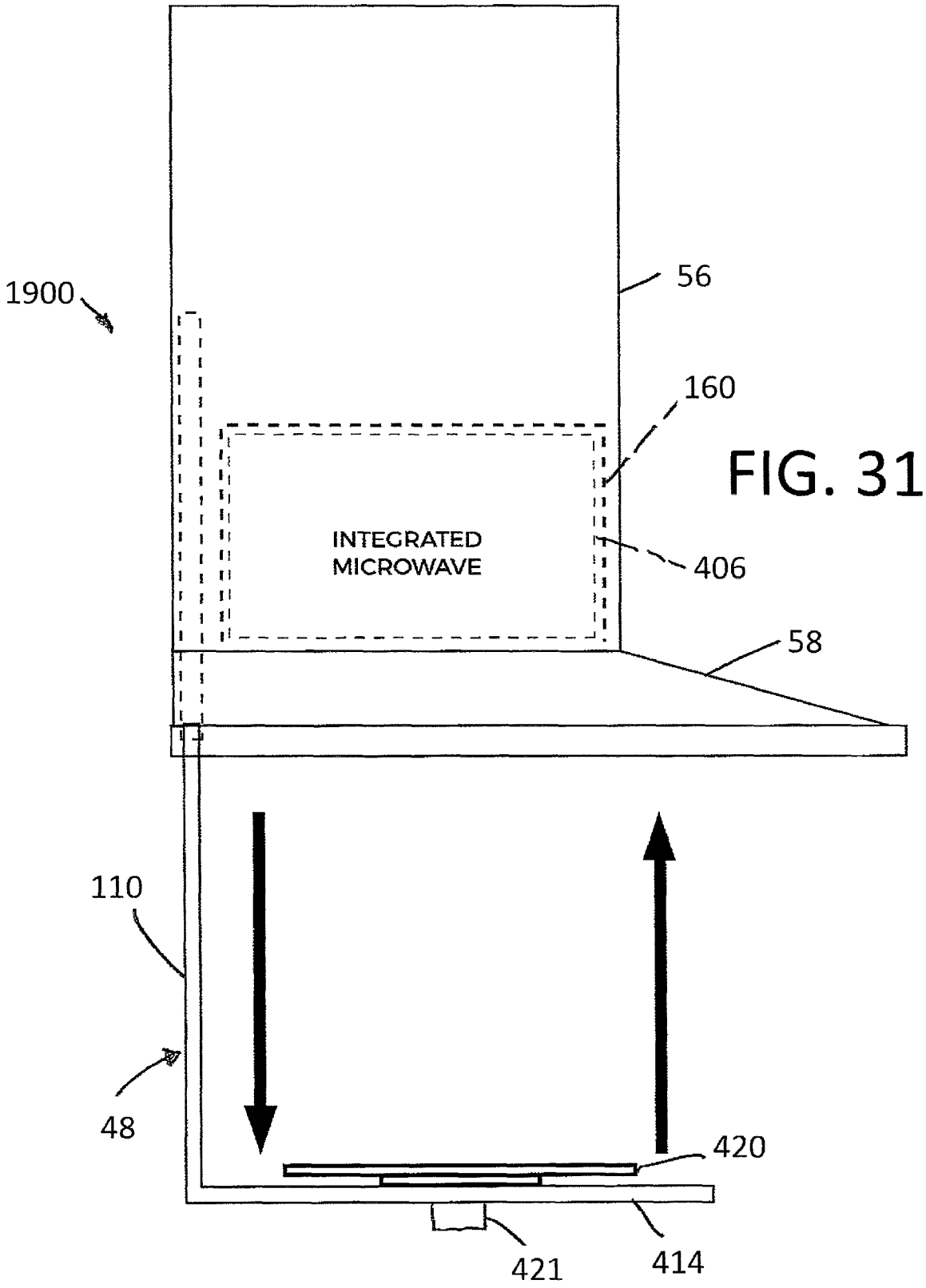
FIG. 31 is a schematic side view of the fourteenth embodiment of FIG. 30.

FIGS. 30 and 31 illustrate an alternate 1900 to the embodiment described in FIGS. 10 and 11 except that the integrated microwave is mounted within the duct 56 instead of the flared portion 58. The duct in FIGS. 30 and 31 has increased transverse dimensions to hold the microwave oven.

It should be noted that many of the features shown in some embodiments can be used in other embodiments as well. For example, the guide wheel 1504 shown in FIG. 20 can be used in any of the embodiment using one or more lifting bars. The various lifting devices, such as rack and pinion, pneumatic cylinders, etc. can be used in any of the embodiments. The manual lifting devices shown in FIGS. 16 and 17 can be adapted to be used in any of the embodiments. The power cords within the duct can be used in any of the embodiments. The use of one lifting bar or two lifting bars can be used in any of the embodiments. The use of a protective sheet metal housing within the hood to protect a lifted microwave oven or other small appliance from greasy deposits from exhausted cooking gas or vapors can be used in any of the embodiments. The use of a tube inside the hood to protect the lifting rods from greasy deposits from exhausted cooking gas or vapors can be used in any of the embodiments. The use of the fan 60 within the hood can be used with any of the embodiments as applicable.

Figure 32:
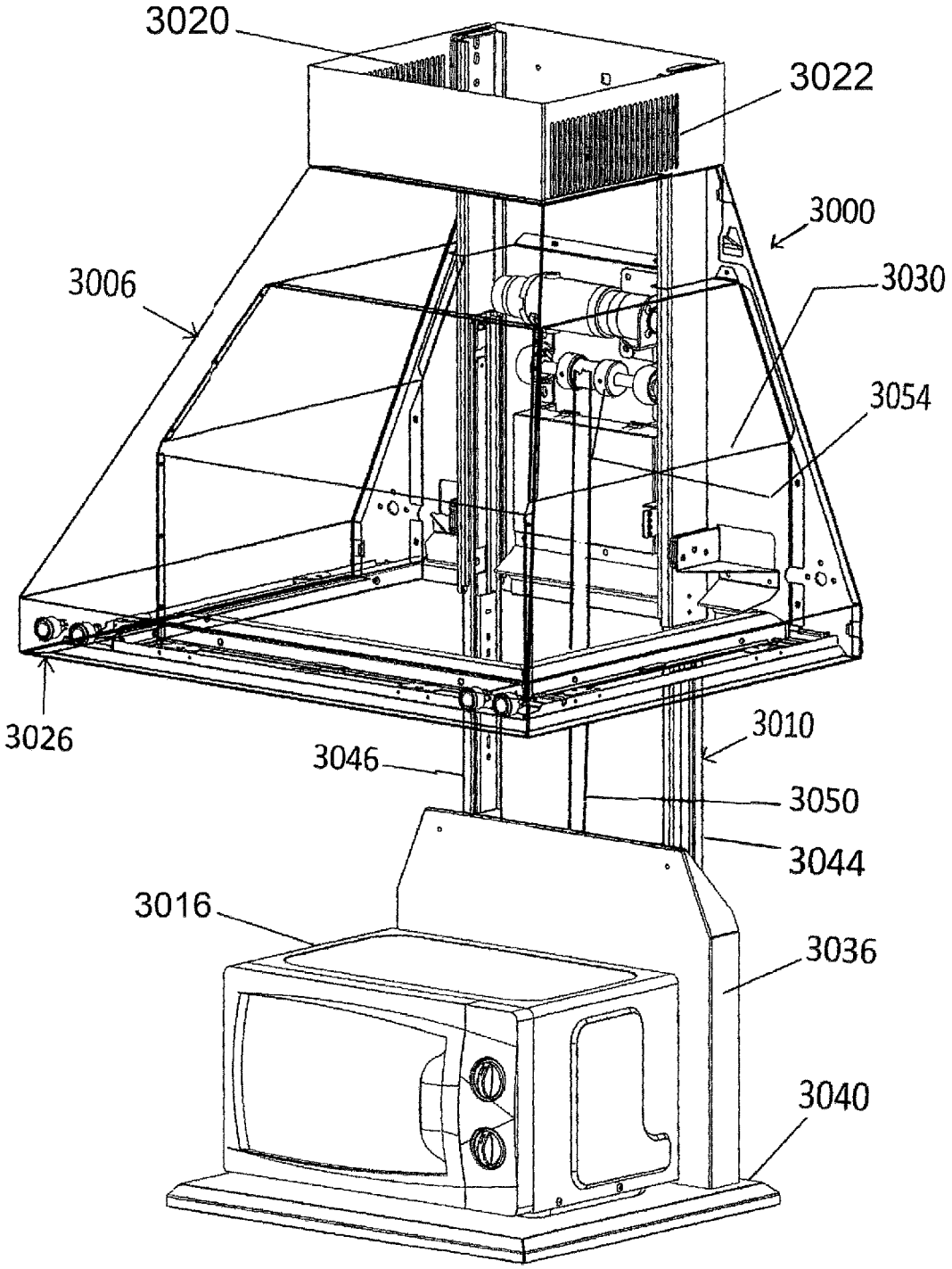
FIG. 32 is a perspective view of a combination of in hood and lifting mechanism according to a further embodiment of the invention, wherein the hood and an isolation chamber within the hood are shown transparently.

FIG. 32 illustrates a further embodiment combination lifting-mechanism and range-hood 3000. The combination includes a hood 3006 and a lifting mechanism 3010, supporting an appliance 3016, such as a microwave oven. The hood 3006 includes side vents 3020, 3022, controls 3026, and an inner isolation chamber 3030. The controls 3026 can be for fan speeds, over range lighting, and for controlling the lifting or lowering of the lifting mechanism 3010.

Lifting mechanism 3010 includes a rear wall 3036 connected to a support plate 3040. The rear wall 3036 is connected to two vertical slides 3044, 3046, via brackets 3045, 3047. These slides 3044, 3046 are constructed is similar fashion to industrial ball-bearing drawer guides or slides, although arranged vertically. A lifting belt 3050, such as a polyester webbing strap, is wrapped around a spool 3054 and extends downward. At a lower end the lifting belt 3050 is wrapped around and attached to an eye bolt 3051. The eye bolt is attached to a cross member 3049 by threading and/or a nut 3053. The cross member 3049 is attached to the two brackets 3045, 3047.

Figure 33:
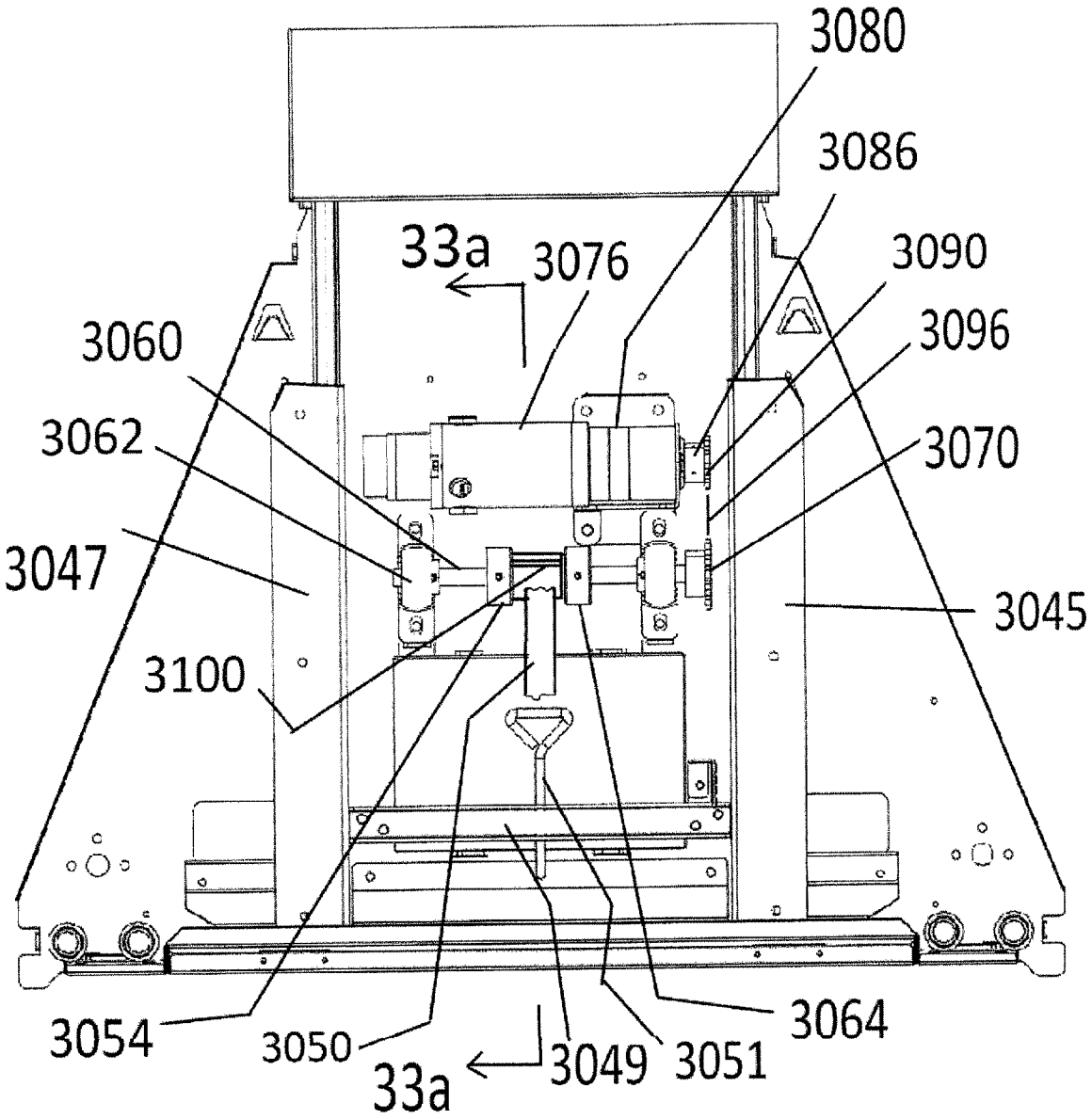
FIG. 33 is a sectional view taken generally through the plane 33-33 shown in FIG. 34.
Figure 33A:
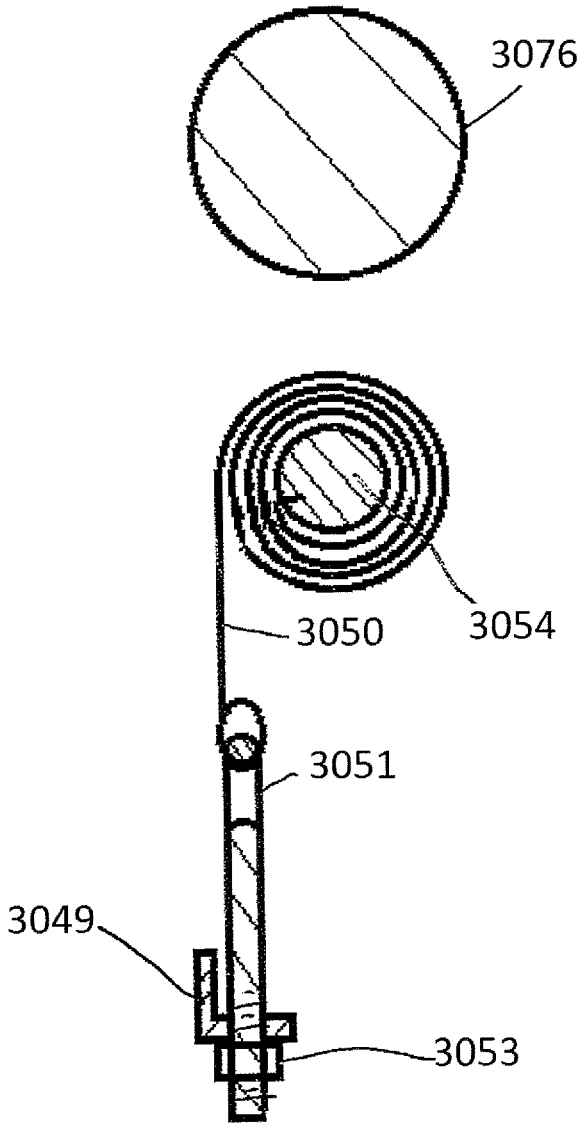
FIG. 33*a* is a sectional view taken generally through the plane 33*a*-33*a* of FIG. 33.

FIGS. 33 and 33*a* show the lifting belt 3050 and the spool 3054. The spool 3054 is fixed for rotation with a splined driveshaft 3060 which is journaled at opposite ends by bearings 3062, 3064. The splined driveshaft 3060 is also fixed to a driven sprocket 3070 on one end. Above the spool is mounted an electric motor 3076 which drives a gearbox 3080 which drives an output shaft 3086. A drive sprocket 3090 is fixed for rotation with the output shaft 3086. A chain 3096 wraps around the drive sprocket 3090 and the driven sprocket 3070. Alternately, the sprockets 3070, 3090 could be replaced with pulleys and the chain 3096 could be replaced with a drive belt.

The spool 3054 includes a slot 3100 for fixing an end of the lifting belt 3050 to the spool. The lifting belt 3050 is wrapped around the spool 3054 numerous times when the support plate 3040 is in the raised position. Driving the electric motor 3076 causes the chain 3096 to turn the driven sprocket 3070 which, depending on the direction of rotation of the motor 3076, either wraps the belts 3050 around the spool 3054 or unwraps the lifting belt 3050 from the spool 3054. Since the lifting belt is fixed to the rear wall 3036, via the eye bolt 3051 and cross member 3049 and brackets 3045, 3047, wrapping the lifting belt around the spool 3054 will cause a raising of the rear wall and support plate 3040, while unwrapping the lifting belt from around the spool 3054 will cause a lowering of the rear wall and the support plate 3040. Position sensors can be used to control the speed of raising and lowering as well as the extent of the raising and lowering.

Figure 34:
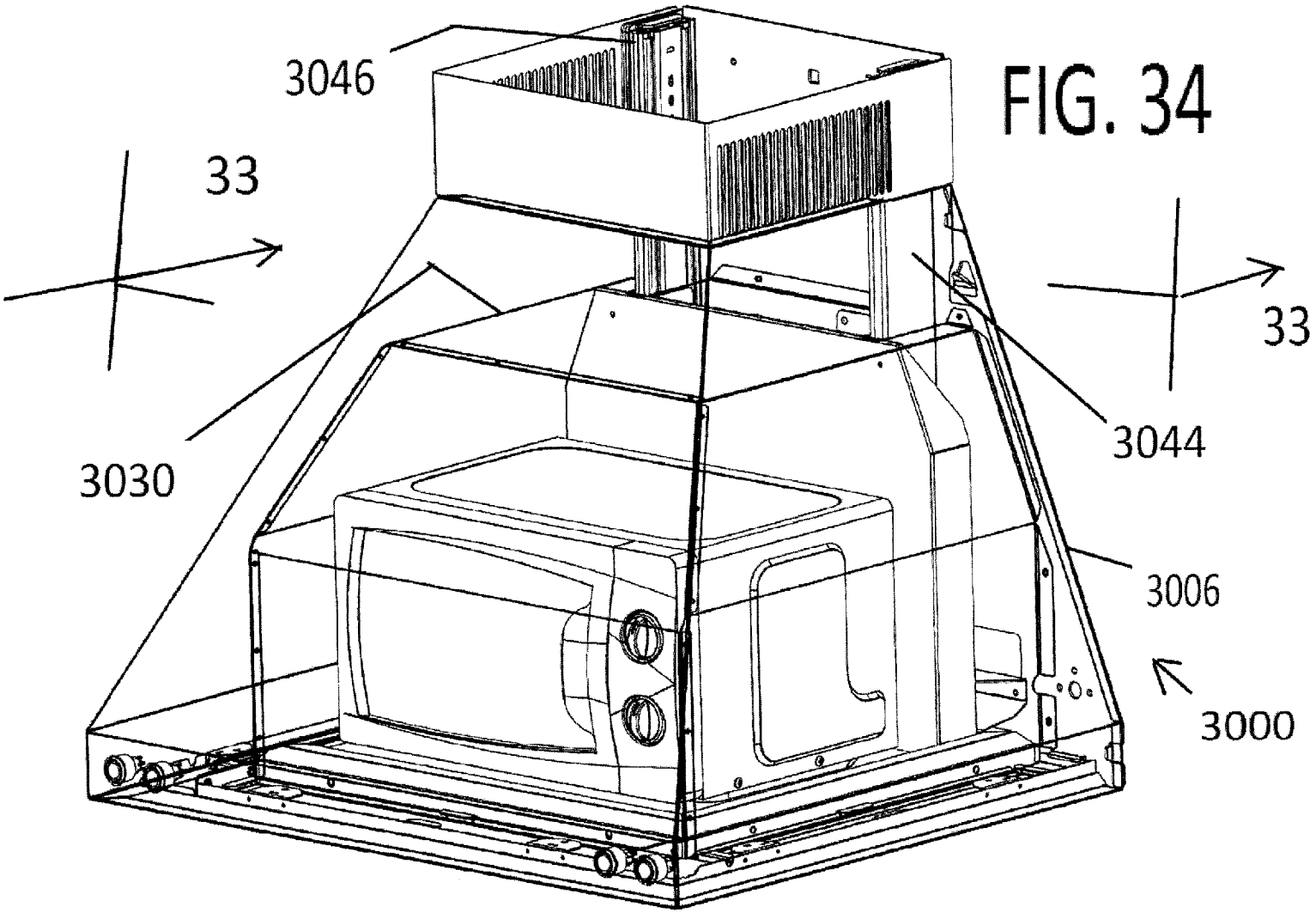
FIG. 34 is a perspective view of the embodiment of FIG. 32 with the lifting mechanism in a completely raised position wherein the hood and the isolation chamber are shown transparently.
Figure 35:
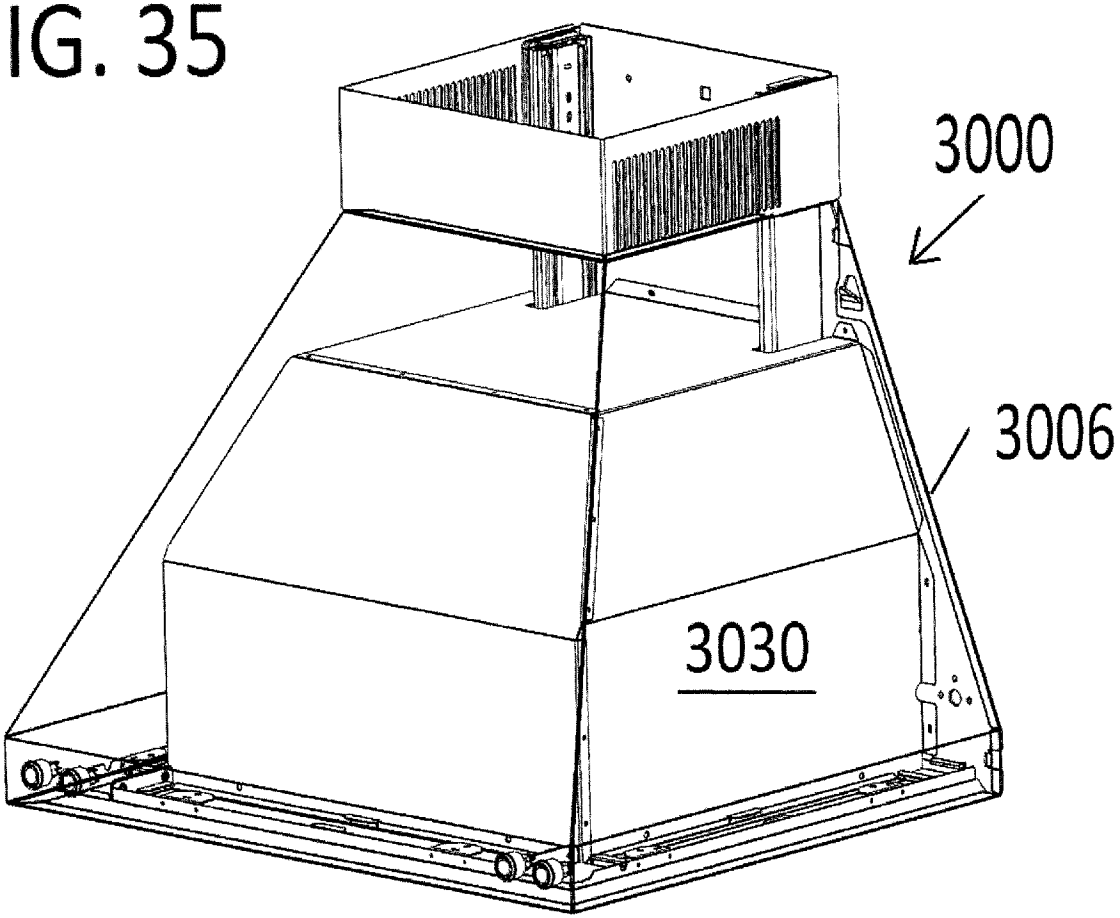
FIG. 35 is a perspective view of the embodiment shown in FIG. 34 showing the isolation chamber within the hood.
Figure 36:
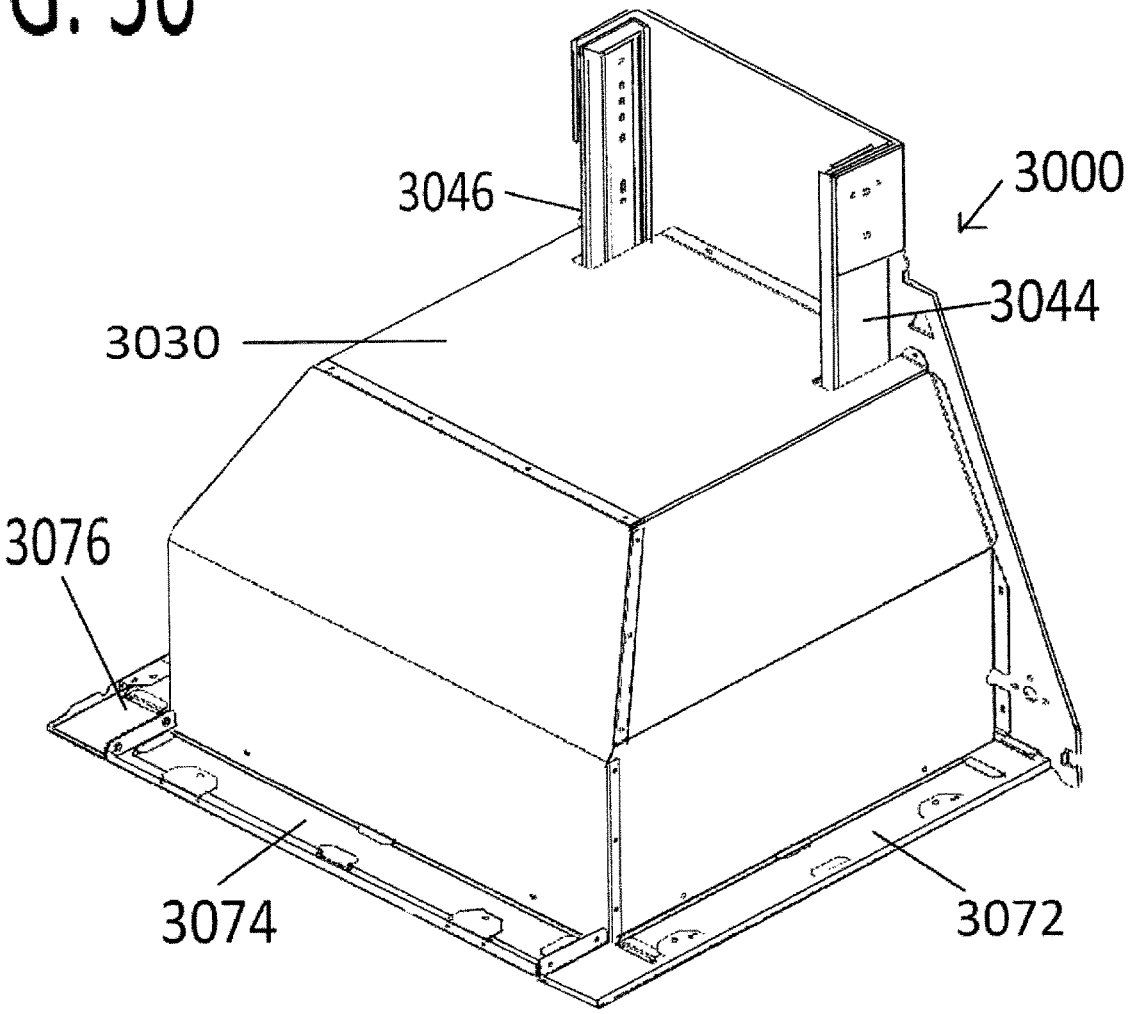
FIG. 36 is a perspective view of a portion of the combination of FIG. 32 which more clearly shows the isolation chamber separate from the surrounding hood.

FIG. 34 illustrates the combination of FIG. 32 with the support plate 3040 in a raised position, positioning the microwave oven within the isolation chamber 3030. The isolation chamber 3030 protects the microwave oven, or other appliance supported on the support plate 3040 from cooking gases and vapors and grease droplets from soiling the microwave oven or other appliance. The isolation chamber 3030 can be a sheet metal compartment.

The support plate 3040 is sized such that when the support plate is fully raised, it closes a bottom of the isolation chamber 3030. The isolation chamber 3030 and the hood 3006 are relatively sized such that there are air and gas flow paths between the inside of the hood 3006 and the outside of the isolation chamber 3030. Surrounding the isolation chamber on three sides, on a bottom side of the hood, are rectangular exhaust gas openings 3072, 3074, 3076, which can be covered by slots, filters or screens.

Figure 37:
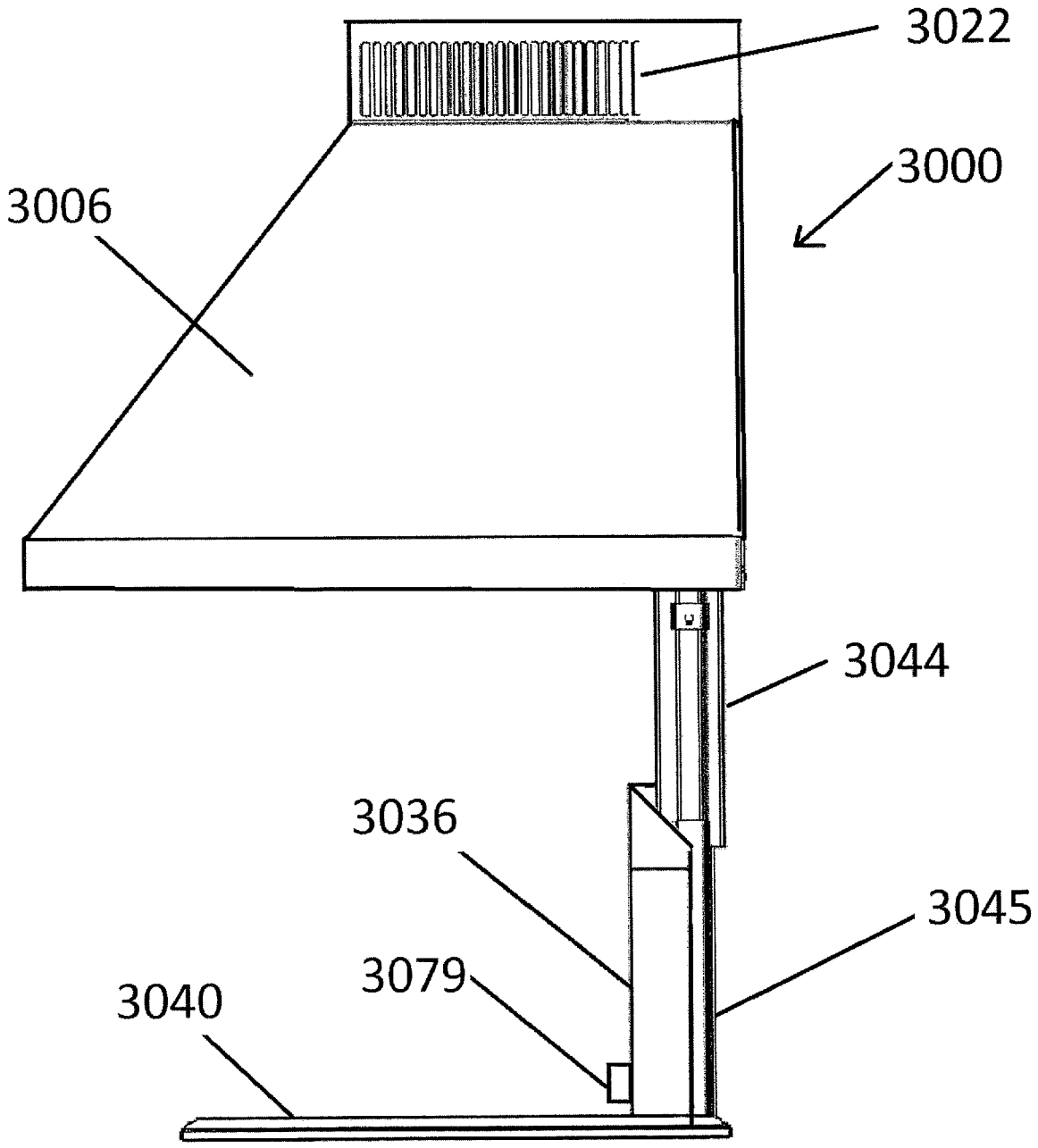
FIG. 37 is a side view of the embodiment of FIG. 32 with the lifting mechanism in the fully lowered position, the appliance not shown for clarity of view.
Figure 38:
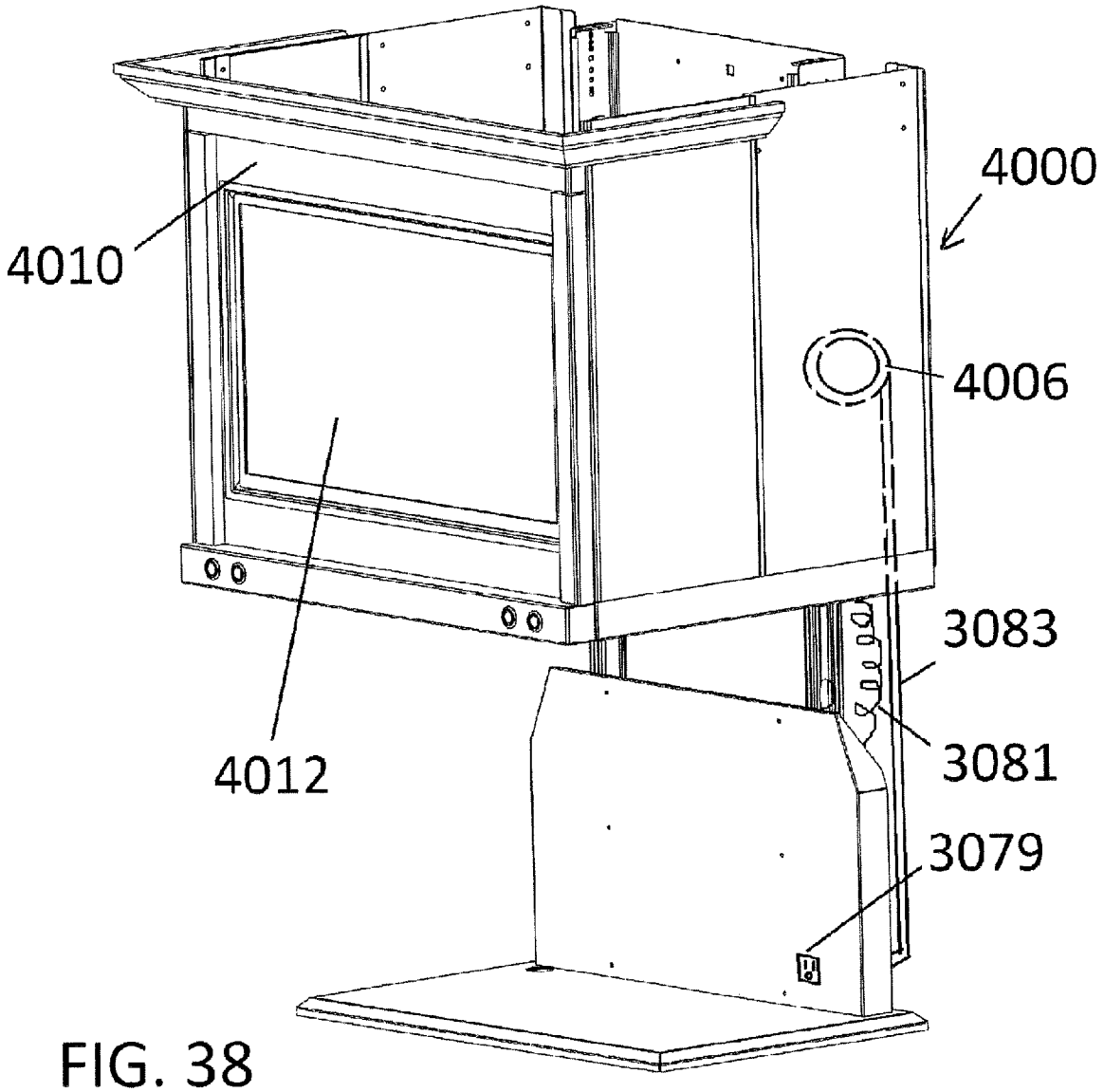
FIG. 38 is a perspective view of a still further embodiment of a hood and lifting mechanism.

Power is delivered to the microwave or other appliance on the support plate via an electrical plug socket 3079 (FIGS. 37 and 38) that is connected to a coiled cord 3081 or a drag carrier 3083 (as shown in FIG. 38). A drag carrier, also known as a drag chain, is a guide designed to surround and guide flexible electrical cables connected to moving automated machinery. These features could also be used with any of the other embodiments disclosed herein.

FIG. 38 illustrates an alternate embodiment combination hood and lifting mechanism 4000. A hood 4006 is box-shaped, rather than the flared shape of the hood of FIG. 32. The box shape provides for a large rectangular front face 4010. A video screen 4012 is installed onto, or into, the front face 4010. The video screen 4012 can be used with a computer (not shown) or television receiver to play programming, such as cooking programs, recipe instructions, news or entertainment. The video screen can have touch screen user input. The lifting mechanism 3010 is as previously described in FIGS. 32-37, or any of the lifting mechanisms described in the specification. The isolation chamber 3030 is located within the hood 4006. Given the box-shaped of the hood 4006 the isolation chamber can be box-shaped as well.

Alternatively, the embodiments of FIG. 10-11 or 30-31, wherein the microwave oven is incorporated into the hood and only the floor or bottom is raised and lowered, could use the video screen of FIG. 38 to control the microwave oven by touch screen control.

A video screen could be incorporated into any of the hood embodiments shown and described in the specification.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. A combination of a range hood and a lifting mechanism for a microwave oven, comprising:

a range hood; and a lifting assembly comprising a support member connected to a support plate, the support member carried by the hood and arranged to be raised and lifted with respect to the hood, the support plate sized and configured to support a microwave oven, the range hood sized and shaped to substantially horizontally conceal a microwave oven in the hood when the support member is raised to an upward position.

2. The combination according to claim 1, wherein when the support member is raised to the upward position the microwave oven is recessed above a lowest edge of the hood.

3. The combination according to claim 1 wherein the lifting assembly comprises a motorized screw drive.

4. The combination according to claim 1, wherein the support member is manually moved between the raised and lowered positions.

5. The combination according to claim 1, wherein the lifting assembly comprises a motorized lifting mechanism for moving the support member between the lowered and raised position.

6. The combination according to claim 1, wherein the lifting assembly comprises a pneumatic or hydraulic cylinder to move the support member between the lowered and raised position.

7. The combination according to claim 1, wherein the lifting assembly comprises a scissor jack to move the support member between the lowered position and the raised position.

8. The combination according to claim 1, wherein the lifting assembly is selected from the group consisting of: a belt wrapped around a rotary driven spool, a scissor jack, a pneumatic or hydraulic cylinder, a screw-drive, and a rack and pinion arrangement.

9. The combination according to claim 1, wherein the support member is located within a tube within the range hood.

10. The combination according to claim 1, further comprising an isolation chamber located within the hood ad sized to receive a microwave oven lifted on the support plate.

11. An assembly for concealing a microwave oven within a range hood, comprising:

a hood having a volume with an open bottom for collecting gas from cooking on a cooking range below the hood;

a lifting mechanism supported by the hood, the lifting mechanism having a motor, a support plate sized and configures to support a microwave oven and a drivetrain receiving power from the motor and effecting raising and lifting of the support plate, the volume sized and configured to receive and conceal a microwave oven lifted up into the hood by the lifting mechanism.

12. The assembly according to claim 11, wherein the drivetrain comprises:

a driving pulley or sprocket driven into rotation by the motor;

a spool supported for rotation and rotationally fixed to a driven sprocket or pulley;

a chain or drive belt wrapped around the driving sprocket or pulley and the driven sprocket or pulley; and a lifting belt wrapped numerous times around the spool when the support plate is in a raised position and operatively connected to the support plate.

13. The assembly according to claim 12, wherein the support plate is guided for vertical movement on a pair of slide bearings and the lifting belt is located between the slide bearings.

14. The assembly according to claim 12, further comprising an isolation chamber fixed within the hood and having an open bottom for receiving a microwave oven into the isolation chamber when the lifting mechanism raises the support plate to an elevated position.

15. The assembly according to claim 11, further comprising an isolation chamber fixed within the hood and having an open bottom for receiving a microwave oven into the isolation chamber when the lifting mechanism raises the support plate to an elevated position.

16. The assembly according to claim 11, wherein the lifting mechanism includes an electrical outlet for electrically connecting the microwave oven and electric power is supplied to the electrical outlet via a coiled cord or conductors guided within a drag carrier.

17. A combination of a range hood and a microwave oven, comprising:

a range hood;

a microwave oven comprising a compartment for receiving food and a movable floor for closing the compartment; and a lifting assembly comprising a support member connected to a support plate, the support member carried by the hood and arranged to be raised and lifted with respect to the hood, the floor supported on the support plate, the compartment fixedly mounted inside the hood, and substantially horizontally concealed in the hood, the floor closing the compartment when the support member is raised to an upward position.

18. The combination according to claim 17, wherein the lifting assembly is selected from the group consisting of: a belt wrapped around a rotary driven spool, a scissor jack, a pneumatic or hydraulic cylinder, a screw-drive, and a rack and pinion arrangement.

* * * * *